US010571124B2

(12) United States Patent
Karkow et al.

(10) Patent No.: US 10,571,124 B2
(45) Date of Patent: Feb. 25, 2020

(54) SELECTABLE DILUTION LOW NOX BURNER

(71) Applicant: CLEARSIGN COMBUSTION CORPORATION, Seattle, WA (US)

(72) Inventors: Douglas W. Karkow, Mount Vernon, IA (US); James K. Dansie, Seattle, WA (US); Jesse Dumas, Seattle, WA (US); Donald Kendrick, Bellevue, WA (US); Igor A. Krichtafovitch, Kirkland, WA (US); Joseph Colannino, Oceanside, CA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 163 days.

(21) Appl. No.: 15/720,899

(22) Filed: Sep. 29, 2017

(65) Prior Publication Data

US 2018/0087774 A1 Mar. 29, 2018

Related U.S. Application Data

(63) Continuation-in-part of application No. 14/763,293, filed as application No. PCT/US2014/016626 on Feb.
(Continued)

(51) Int. Cl.

| | |
|---|---|
| ***F23D 14/14*** | (2006.01) |
| ***F23N 1/00*** | (2006.01) |
| ***F23N 5/26*** | (2006.01) |

(52) U.S. Cl.
CPC ..... *F23N 1/005* (2013.01); *F23D 14/14* (2013.01); *F23N 5/265* (2013.01);
(Continued)

(58) Field of Classification Search
CPC ..... F23D 14/14
(Continued)

(56) References Cited

U.S. PATENT DOCUMENTS 2,095,065 A 10/1937 Hays
2,604,936 A 7/1952 Kaehni et al.
(Continued)

FOREIGN PATENT DOCUMENTS

CN 101046304 10/2007
EP 0844434 5/1998
(Continued)

OTHER PUBLICATIONS

U.S. Appl. No. 15/666,941, filed Aug. 2, 2017, Dumas.
(Continued)

*Primary Examiner* — Avinash A Savani
(74) *Attorney, Agent, or Firm* — Christopher A. Wiklof; James C. Larsen; Launchpad IP, Inc.

(57) ABSTRACT

A burner supporting primary and secondary combustion reactions may include a primary combustion reaction actuator configured to select a location of the secondary combustion reaction. A burner may include a perforated flame holder structure configured to support a secondary combustion reaction above a partial premixing region. The secondary flame support location may be selected as a function of a turndown parameter. Selection logic may be of arbitrary complexity.

62 Claims, 12 Drawing Sheets

Related U.S. Application Data

14, 2014, now Pat. No. 9,803,855, application No. 15/720,899, which is a continuation-in-part of application No. 14/762,155, filed as application No. PCT/US2014/016632 on Feb. 14, 2014, now Pat. No. 9,797,595, application No. 15/720,899, which is a continuation-in-part of application No. PCT/US2017/013523, filed on Jan. 13, 2017.

(60) Provisional application No. 62/394,110, filed on Sep. 13, 2016, provisional application No. 62/411,374, filed on Oct. 21, 2016, provisional application No. 61/765,022, filed on Feb. 14, 2013, provisional application No. 61/931,407, filed on Jan. 24, 2014, provisional application No. 62/278,350, filed on Jan. 13, 2016.

(52) U.S. Cl.
CPC ..... *F23N 2027/02* (2013.01); *F23N 2027/28* (2013.01); *F23N 2029/00* (2013.01); *F23N 2037/02* (2013.01); *F23N 2900/00* (2013.01)

(58) Field of Classification Search
USPC ..... 431/354, 266, 264
See application file for complete search history.

(56) References Cited

U.S. PATENT DOCUMENTS 2,828,813 A 4/1958 Holden
3,004,137 A 10/1961 Karlovitz
3,008,513 A 11/1961 Holden
3,076,605 A 2/1963 Holden
3,087,472 A 4/1963 Yukichi
3,167,109 A 1/1965 Wobig
3,224,485 A 12/1965 Blomgren, Sr. et al.
3,228,614 A 1/1966 Bauer
3,306,338 A 2/1967 Wright et al.
3,324,924 A 6/1967 Hailstone et al.
3,416,870 A 12/1968 Wright
3,439,996 A 4/1969 Lherault et al.
3,661,499 A 5/1972 Krieger
3,687,602 A 8/1972 Vignes
3,729,288 A * 4/1973 Berlincourt ..... F23Q 2/287 431/264
3,749,545 A 7/1973 Velkoff
3,841,824 A 10/1974 Bethel
3,847,536 A 11/1974 Lepage
4,020,388 A 4/1977 Pratt, Jr.
4,021,188 A 5/1977 Yamagishi et al.
4,052,139 A 10/1977 Paillaud et al.
4,081,958 A 4/1978 Schelp
4,111,636 A 9/1978 Goldberg
4,239,973 A 12/1980 Kolbe et al.
4,397,356 A 8/1983 Retallick
4,408,461 A 10/1983 Bruhwiler et al.
4,413,976 A 11/1983 Scherer
4,428,726 A * 1/1984 Kimpara ..... F23D 14/725 431/350
4,483,673 A 11/1984 Murai et al.
4,519,770 A 5/1985 Kesselring
4,588,373 A 5/1986 Tonon et al.
4,643,667 A 2/1987 Fleming
4,652,236 A 3/1987 Viessmann
4,673,349 A 6/1987 Abe et al.
4,726,767 A 2/1988 Nakajima
4,752,213 A 6/1988 Grochowski et al.
4,773,847 A 9/1988 Shukla et al.
4,850,862 A 7/1989 Bjerklie
4,899,696 A 2/1990 Kennedy et al.
4,910,637 A 3/1990 Hanna
4,919,609 A 4/1990 Sarkisian et al.
5,235,667 A 8/1993 Canfield et al.
5,248,255 A 9/1993 Morioka et al.
5,275,552 A 1/1994 Schwartz et al.
5,326,257 A 7/1994 Taylor et al.
5,375,999 A 12/1994 Aizawa et al.
5,380,192 A 1/1995 Hamos
5,431,557 A 7/1995 Hamos
5,439,372 A 8/1995 Duret et al.
5,441,402 A 8/1995 Reuther et al.
5,458,484 A 10/1995 Ripka
5,511,516 A 4/1996 Moore, Jr. et al.
5,511,974 A 4/1996 Gordon et al.
5,641,282 A 6/1997 Lee et al.
5,667,374 A 9/1997 Nutcher et al.
5,685,708 A 11/1997 Palmer-Jones
5,713,206 A 2/1998 McWhirter et al.
5,718,573 A 2/1998 Knight et al.
5,784,889 A 7/1998 Joos et al.
5,846,067 A 12/1998 Nishiyama et al.
5,890,886 A 4/1999 Doker et al.
5,899,686 A 5/1999 Carbone et al.
5,957,682 A 9/1999 Kamal et al.
6,095,798 A 8/2000 Mitani et al.
6,159,001 A 12/2000 Kushch et al.
6,499,990 B1 12/2002 Zink et al.
6,887,069 B1 5/2005 Thornton et al.
6,997,701 B2 2/2006 Volkert et al.
7,137,808 B2 11/2006 Branston et al.
7,243,496 B2 7/2007 Pavlik et al.
7,360,506 B2 4/2008 Shellenberger et al.
7,523,603 B2 4/2009 Hagen et al.
7,666,367 B1 2/2010 Durst et al.
7,670,135 B1 3/2010 Zink et al.
7,878,798 B2 2/2011 Poe et al.
7,927,095 B1 4/2011 Chorpening et al.
8,082,725 B2 12/2011 Younsi et al.
8,282,389 B2 10/2012 Dhulst et al.
8,851,882 B2 10/2014 Hartwick et al.
8,881,535 B2 11/2014 Hartwick et al.
8,911,699 B2 12/2014 Colannino et al.
9,062,882 B2 6/2015 Hangauer et al.
9,243,800 B2 1/2016 Goodson et al.
9,377,190 B2 6/2016 Karkow et al.
9,388,981 B2 7/2016 Karkow et al.
9,447,965 B2 9/2016 Karkow et al.
2002/0155403 A1 10/2002 Griffin et al.
2002/0197574 A1 12/2002 Jones et al.
2003/0138629 A1 7/2003 Dewaegheneire
2004/0058290 A1 3/2004 Mauzey et al.
2004/0081933 A1 4/2004 St. Charles et al.
2004/0197719 A1 10/2004 Chung et al.
2005/0208442 A1 9/2005 Heiligers et al.
2006/0008755 A1 1/2006 Leinemann et al.
2006/0035190 A1 2/2006 Hoetger et al.
2006/0141413 A1 6/2006 Masten et al.
2006/0165555 A1 7/2006 Spielman et al.
2007/0020567 A1 1/2007 Branston et al.
2007/0292811 A1 12/2007 Poe et al.
2008/0124666 A1 5/2008 Stocker et al.
2008/0145802 A1 6/2008 Hammer et al.
2008/0268387 A1 10/2008 Saito et al.
2009/0056923 A1 3/2009 Lin
2009/0111063 A1 4/2009 Boardman et al.
2010/0077731 A1 4/2010 Jeong et al.
2010/0178219 A1 7/2010 Verykios et al.
2011/0027734 A1 2/2011 Hartwick et al.
2011/0044868 A1 2/2011 Lee et al.
2011/0072786 A1 3/2011 Tokuda et al.
2011/0076628 A1 3/2011 Miura et al.
2011/0203771 A1 8/2011 Goodson et al.
2012/0135360 A1 5/2012 Hannum et al.
2012/0156628 A1 6/2012 Lochschmied et al.
2012/0164590 A1 6/2012 Mach
2012/0231398 A1 9/2012 Carpentier et al.
2012/0276487 A1 11/2012 Hangauer et al.
2013/0004902 A1 1/2013 Goodson et al.
2013/0071794 A1 3/2013 Colannino et al.
2013/0170090 A1 7/2013 Colannino et al.
2013/0230810 A1 9/2013 Goodson et al.
2013/0230811 A1 9/2013 Goodson et al.

(56) References Cited

U.S. PATENT DOCUMENTS

| | | | |
|---|---|---|---|
| 2013/0255482 | A1 | 10/2013 | Goodson |
| 2013/0255548 | A1 | 10/2013 | Goodson et al. |
| 2013/0255549 | A1 | 10/2013 | Sonnichsen et al. |
| 2013/0260321 | A1 | 10/2013 | Colannino et al. |
| 2013/0291552 | A1 | 11/2013 | Smith et al. |
| 2013/0323655 | A1 | 12/2013 | Krichtafovitch et al. |
| 2013/0323661 | A1 | 12/2013 | Goodson et al. |
| 2013/0333279 | A1 | 12/2013 | Osler et al. |
| 2013/0336352 | A1 | 12/2013 | Colannino et al. |
| 2014/0038113 | A1 | 2/2014 | Breidenthal et al. |
| 2014/0051030 | A1 | 2/2014 | Colannino et al. |
| 2014/0065558 | A1 | 3/2014 | Colannino et al. |
| 2014/0076212 | A1 | 3/2014 | Goodson et al. |
| 2014/0080070 | A1 | 3/2014 | Krichtafovitch et al. |
| 2014/0162195 | A1 | 6/2014 | Lee et al. |
| 2014/0162196 | A1 | 6/2014 | Krichtafovitch et al. |
| 2014/0162197 | A1 | 6/2014 | Krichtafovitch et al. |
| 2014/0162198 | A1 | 6/2014 | Krichtafovitch et al. |
| 2014/0170569 | A1 | 6/2014 | Anderson et al. |
| 2014/0170571 | A1 | 6/2014 | Casasanta, III et al. |
| 2014/0170575 | A1 | 6/2014 | Krichtafovitch |
| 2014/0170576 | A1 | 6/2014 | Colannino et al. |
| 2014/0170577 | A1 | 6/2014 | Colannino et al. |
| 2014/0186778 | A1 | 7/2014 | Colannino et al. |
| 2014/0196368 | A1 | 7/2014 | Wiklof |
| 2014/0196369 | A1 | 7/2014 | Wiklof |
| 2014/0208758 | A1 | 7/2014 | Breidenthal et al. |
| 2014/0212820 | A1 | 7/2014 | Colannino et al. |
| 2014/0216401 | A1 | 8/2014 | Colannino et al. |
| 2014/0227645 | A1 | 8/2014 | Krichtafovitch et al. |
| 2014/0227646 | A1 | 8/2014 | Krichtafovitch et al. |
| 2014/0227649 | A1 | 8/2014 | Krichtafovitch et al. |
| 2014/0234786 | A1 | 8/2014 | Ruiz et al. |
| 2014/0234789 | A1 | 8/2014 | Ruiz et al. |
| 2014/0248566 | A1 | 9/2014 | Krichtafovitch et al. |
| 2014/0251191 | A1 | 9/2014 | Goodson et al. |
| 2014/0255855 | A1 | 9/2014 | Krichtafovitch |
| 2014/0255856 | A1 | 9/2014 | Colannino et al. |
| 2014/0272730 | A1 | 9/2014 | Krichtafovitch et al. |
| 2014/0272731 | A1 | 9/2014 | Breidenthal et al. |
| 2014/0287368 | A1 | 9/2014 | Krichtafovitch et al. |
| 2014/0287376 | A1 | 9/2014 | Krichtafovitch et al. |
| 2014/0295094 | A1 | 10/2014 | Casasanta et al. |
| 2014/0295360 | A1 | 10/2014 | Wiklof |
| 2014/0335460 | A1 | 11/2014 | Wiklof et al. |
| 2014/0338350 | A1 | 11/2014 | Breidenthal |
| 2015/0079524 | A1 | 3/2015 | Colannino et al. |
| 2015/0104748 | A1 | 4/2015 | Dumas et al. |
| 2015/0107260 | A1 | 4/2015 | Colannino et al. |
| 2015/0118629 | A1 | 4/2015 | Colannino et al. |
| 2015/0121890 | A1 | 5/2015 | Colannino et al. |
| 2015/0140498 | A1 | 5/2015 | Colannino |
| 2015/0147704 | A1 | 5/2015 | Krichtafovitch et al. |
| 2015/0147705 | A1 | 5/2015 | Colannino et al. |
| 2015/0147706 | A1 | 5/2015 | Krichtafovitch et al. |
| 2015/0219333 | A1 | 8/2015 | Colannino et al. |
| 2015/0226424 | A1 | 8/2015 | Breidenthal et al. |
| 2015/0241057 | A1 | 8/2015 | Krichtafovitch et al. |
| 2015/0276211 | A1 | 10/2015 | Colannino et al. |
| 2015/0276212 | A1 | 10/2015 | Karkow et al. |
| 2015/0276213 | A1 | 10/2015 | Karkow et al. |
| 2015/0276217 | A1 | 10/2015 | Karkow et al. |
| 2015/0276220 | A1 | 10/2015 | Karkow et al. |
| 2015/0285491 | A1 | 10/2015 | Karkow et al. |
| 2015/0316261 | A1 | 11/2015 | Karkow et al. |
| 2015/0330625 | A1 | 11/2015 | Karkow et al. |
| 2015/0338089 | A1 | 11/2015 | Krichtafocitch et al. |
| 2015/0345780 | A1 | 12/2015 | Krichtafovitch |
| 2015/0345781 | A1 | 12/2015 | Krichtafovitch et al. |
| 2015/0362177 | A1 | 12/2015 | Krichtafovitch et al. |
| 2015/0362178 | A1 | 12/2015 | Karkow et al. |
| 2015/0369476 | A1 | 12/2015 | Wiklof |
| 2015/0369477 | A1 | 12/2015 | Karkow et al. |
| 2016/0003471 | A1 | 1/2016 | Karkow et al. |
| 2016/0018103 | A1 | 1/2016 | Karkow et al. |
| 2016/0025333 | A1 | 1/2016 | Karkow et al. |
| 2016/0025374 | A1 | 1/2016 | Karkow et al. |
| 2016/0025380 | A1 | 1/2016 | Karkow et al. |
| 2016/0046524 | A1 | 2/2016 | Colannino et al. |
| 2016/0047542 | A1 | 2/2016 | Wiklof et al. |
| 2016/0091200 | A1 | 3/2016 | Colannino et al. |
| 2016/0109118 | A1 | 4/2016 | Krichtafovitch et al. |
| 2016/0123576 | A1 | 5/2016 | Colannino et al. |
| 2016/0123577 | A1 | 5/2016 | Dumas et al. |
| 2016/0138799 | A1 | 5/2016 | Colannino et al. |
| 2016/0161110 | A1 | 6/2016 | Krichtafovitch et al. |
| 2016/0161115 | A1 | 6/2016 | Krichtafovitch et al. |
| 2016/0230984 | A1 | 8/2016 | Colannino et al. |
| 2016/0238240 | A1 | 8/2016 | Colannino et al. |
| 2016/0238242 | A1 | 8/2016 | Karkow et al. |
| 2016/0238277 | A1 | 8/2016 | Colannino et al. |
| 2016/0238318 | A1 | 8/2016 | Colannino et al. |
| 2016/0245507 | A1 | 8/2016 | Goodson et al. |
| 2016/0245509 | A1 | 8/2016 | Karkow et al. |
| 2016/0298840 | A1 | 10/2016 | Karkow et al. |
| 2016/0305660 | A1 | 10/2016 | Colannino et al. |
| 2016/0348899 | A1 | 12/2016 | Karkow et al. |
| 2016/0348900 | A1 | 12/2016 | Colannino et al. |
| 2016/0348901 | A1 | 12/2016 | Karkow et al. |
| 2016/0363315 | A1 | 12/2016 | Colannino et al. |
| 2017/0010019 | A1 | 1/2017 | Karkow et al. |
| 2017/0038063 | A1 | 2/2017 | Colannino et al. |
| 2017/0038064 | A1 | 2/2017 | Colannino et al. |
| 2017/0051913 | A1 | 2/2017 | Colannino et al. |
| 2017/0184303 | A1 | 6/2017 | Colannino et al. |
| 2017/0191655 | A1 | 7/2017 | Colannino et al. |
| 2017/0268772 | A1 | 9/2017 | Lang et al. |
| 2017/0307212 | A1 | 10/2017 | Kendrick |

FOREIGN PATENT DOCUMENTS

| | | |
|---|---|---|
| EP | 0866296 | 9/1998 |
| EP | 1139020 | 8/2006 |
| EP | 2148137 | 1/2010 |
| EP | 2738460 | 6/2014 |
| FR | 2577304 | 12/1989 |
| GB | 1042014 | 9/1966 |
| GB | 2456861 | 7/2009 |
| JP | 60-073242 | 4/1985 |
| JP | 60-216111 | 10/1985 |
| JP | 61-265404 | 11/1986 |
| JP | 06-026624 | 2/1994 |
| JP | H 07-48136 | 2/1995 |
| JP | 07-083076 | 3/1995 |
| JP | 2006-275482 | 10/2006 |
| WO | WO 1995/000803 | 1/1995 |
| WO | WO 1995/034784 | 12/1995 |
| WO | WO 2004/042280 | 5/2004 |
| WO | WO 2012/109499 | 8/2012 |
| WO | WO 2013/181569 | 12/2013 |
| WO | WO 2014/127311 | 8/2014 |
| WO | WO 2014/160830 | 10/2014 |
| WO | WO 2014/197108 | 12/2014 |
| WO | WO 2015/012872 | 1/2015 |
| WO | WO 2015/017084 | 2/2015 |
| WO | WO 2015/017087 | 2/2015 |
| WO | WO 2015/038245 | 3/2015 |
| WO | WO 2015/042566 | 3/2015 |
| WO | WO 2015/042614 | 3/2015 |
| WO | WO 2015/042615 | 3/2015 |
| WO | WO 2015/051136 | 4/2015 |
| WO | WO 2015/051377 | 4/2015 |
| WO | WO 2015/054323 | 4/2015 |
| WO | WO 2015/057740 | 4/2015 |
| WO | WO 2015/061760 | 4/2015 |
| WO | WO 2015/070188 | 5/2015 |
| WO | WO 2015/089306 | 6/2015 |
| WO | WO 2015/103436 | 7/2015 |
| WO | WO 2015/112950 | 7/2015 |
| WO | WO 2015/123149 | 8/2015 |
| WO | WO 2015/123381 | 8/2015 |
| WO | WO 2015/123670 | 8/2015 |
| WO | WO 2015/123683 | 8/2015 |
| WO | WO 2015/123694 | 8/2015 |

(56) References Cited

FOREIGN PATENT DOCUMENTS

| | | |
|---|---|---|
| WO | WO 2015/123696 | 8/2015 |
| WO | WO 2015/123701 | 8/2015 |
| WO | WO 2016/003883 | 1/2016 |
| WO | WO 2016/007564 | 1/2016 |
| WO | WO 2016/018610 | 2/2016 |
| WO | WO 2016/105489 | 6/2016 |
| WO | WO 2016/133934 | 8/2016 |
| WO | WO 2016/133936 | 8/2016 |
| WO | WO 2016/134061 | 8/2016 |
| WO | WO 2016/134068 | 8/2016 |
| WO | WO 2016/140681 | 9/2016 |
| WO | WO 2016/141362 | 9/2016 |
| WO | WO 2017/048638 | 3/2017 |
| WO | WO 2017/124008 | 7/2017 |
| WO | PCT/US2017/046372 | 8/2017 |
| WO | PCT/US2017/058848 | 10/2017 |
| WO | WO 2017/190080 | 11/2017 |

OTHER PUBLICATIONS

U.S. Appl. No. 14/878,391, filed Oct. 8, 2015, Colannino et al.
U.S. Appl. No. 14/061,477, filed Oct. 3, 2013, Krichtafovitch et al.
U.S. Appl. No. 14/827,390, filed Aug. 17, 2015, Wiklof et al.
U.S. Appl. No. 14/746,592, filed Jun. 22, 2015, Wiklof.
U.S. Appl. No. 14/845,681, filed Sep. 4, 2015, Krichtafovitch et al.
U.S. Appl. No. 14/931,020, filed Nov. 3, 2015, Dumas et al.
U.S. Appl. No. 15/637,820, filed Jun. 29, 2017, Karkow et al.
U.S. Appl. No. 15/663,458, filed Jul. 28, 2017, Colannino et al.
U.S. Appl. No. 15/668,562, filed Aug. 3, 2017, Karkow et al.
U.S. Appl. No. 15/669,702, filed Aug. 4, 2017, Karkow et al.
U.S. Appl. No. 15/667,565, filed Aug. 2, 2017, Karkow et al.
U.S. Appl. No. 62/105,328, filed Jan. 20, 2015, Colannino et al.
PCT International Search Report and Written Opinion of International PCT Application No. PCT/US2014/016626 dated Jun. 3, 2014.
F. Altendorfner et al., Electric Field Effects on Emissions and Flame Stability with Optimized Electric Field Geometry, The European Combustion Meeting ECM 2007, 2007, 1-6, Germany.
Timothy J.C. Dolmansley et al., Electrical Modification of Combustion and the Affect of Electrode Geometry on the Field Produced, Modelling and Simulation in Engineering, May 26, 2011, 1-13, vol. 2011, Himdawi Publishing Corporation.
M. Abdul Mujeebu et al., Applications of Porous Media Combustion Technology—A Review, Applied Energy, 2009, 1365-1375, Great Britain.
Fric , Thomas F, "Effects of Fuel-Air Unmixedness on NOx Emissions," Sep.-Oct. 1993. Journal of Propulsion and Power, vol. 9, No. 5, pp. 708-713.
M. Zake et al., "Electric Field Control of NOx Formation in the Flame Channel Flows." Global Nest: The Int. J. May 2000, vol. 2, No. 1, pp. 99-108.
EPO Extended Search Report and Search Opinion of EP Application No. 14751185.1 dated Feb. 21, 2017.
Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.
James Lawton and Felix J. Weinberg. "Electrical Aspects of Combustion." Clarendon Press, Oxford. 1969, p. 141, formula 4.131a.
Arnold Schwarzenegger, "A Low NOx Porous Ceramics Burner Performance Study," California Energy Commission Public Interest Energy Research Program, Dec. 2007, San Diego State University Foundation.
EPO Extended Search Report and Search Opinion of EP Application No. 14752039.9 dated Sep. 23, 2016.
Kim, S.G. et al., "Flame behavior in heated porous sand bed," Proceedings of the Combustion Institute 31, Jan. 2007, pp. 2117-2124.
Takeno, Abstract, Combustion Institute 1982, 1 page.
PCT International Search Report and Written Opinion of International PCT Application No. PCT/US2014/016632 dated May 26, 2014.
PCT International Search Report and Written Opinion of International PCT Application No. PCT/US2017/013523 dated Jun. 13, 2017.
PCT International Search Report and Written Opinion of International PCT Application No. PCT/US2014/016622 dated May 27, 2014.
PCT International Search Report and Written Opinion of International PCT Application No. PCT/US2014/016628 dated May 27, 2014.

* cited by examiner

SELECTABLE DILUTION LOW NOX BURNER

CROSS-REFERENCE TO RELATED APPLICATIONS

The present application is a continuation-in-part of U.S. patent application Ser. No. 14/763,293, entitled "SELECTABLE DILUTION LOW NOx BURNER," filed Jul. 24, 2015. U.S. patent application Ser. No. 14/763,293 is a U.S. National Phase Application under 35 U.S.C. § 371 of International Patent Application No. PCT/US2014/016626, entitled "SELECTABLE DILUTION LOW NOx BURNER," filed Feb. 14, 2014; International Patent Application No. PCT/US2014/016626 claims the benefit of U.S. Provisional Patent Application No. 61/765,022, entitled "PERFORATED FLAME HOLDER AND BURNER INCLUDING A PERFORATED FLAME HOLDER," filed Feb. 14, 2013, now expired. The present application is a continuation-in-part of U.S. patent application Ser. No. 14/762,155, entitled "FUEL COMBUSTION SYSTEM WITH A PERFORATED REACTION HOLDER," filed Jul. 20, 2015; U.S. patent application Ser. No. 14/762,155 is a U.S. National Phase Application under 35 U.S.C. § 371 of International Patent Application No. PCT/US2014/016632, entitled "FUEL COMBUSTION SYSTEM WITH A PERFORATED REACTION HOLDER," filed Feb. 14, 2014; International Patent Application No. PCT/US2014/016632 claims the benefit of U.S. Provisional Patent Application No. 61/765,022, entitled "PERFORATED FLAME HOLDER AND BURNER INCLUDING A PERFORATED FLAME HOLDER," filed Feb. 14, 2013, and U.S. Provisional Patent Application No. 61/931,407, entitled "LOW NOx FIRE TUBE BOILER," filed Jan. 24, 2014. The present application is a continuation-in-part of International Patent Application No. PCT/US2017/013523, entitled "PERFORATED FLAME HOLDER WITH GAPS BETWEEN TILE GROUPS," filed Jan. 13, 2017; International Patent Application No. PCT/US2017/013523 claims the benefit of U.S. Provisional Patent Application No. 62/278,350, entitled "PERFORATED FLAME HOLDER WITH GAPS BETWEEN TILE GROUPS," filed Jan. 13, 2016, U.S. Provisional Patent Application No. 62/394,110, entitled "PLUG AND PLAY BURNER WITH A PERFORATED FLAME HOLDER," filed Sep. 13, 2016, and U.S. Provisional Patent Application No. 62/411,374, entitled "PLUG AND PLAY ENHANCEMENTS," filed Oct. 21, 2016. U.S. patent application Ser. No. 14/763,293, International Patent Application No. PCT/US2014/016626, U.S. Provisional Patent Application No. 61/765,022, U.S. Provisional Patent Application No. 61/931,407, U.S. patent application Ser. No. 14/762,155, International Patent Application No. PCT/US2014/016632, International Patent Application No. PCT/US2017/013523, U.S. Provisional Patent Application No. 62/278,350, U.S. Provisional Patent Application No. 62/394,110, and U.S. Provisional Patent Application No. 62/411,374, are each, to the extent not inconsistent with the disclosure herein, incorporated by reference.

The present application is related to International Patent Application No. PCT/US2014/016628, entitled "PERFORATED FLAME HOLDER AND BURNER INCLUDING A PERFORATED FLAME HOLDER," filed Feb. 14, 2014; International Patent Application No. PCT/US2014/016632, entitled "FUEL COMBUSTION SYSTEM WITH A PERFORATED REACTION HOLDER," filed Feb. 14, 2014; and International Patent Application No. PCT/US2014/016622, entitled "STARTUP METHOD AND MECHANISM FOR A BURNER HAVING A PERFORATED FLAME HOLDER," filed Feb. 14, 2014; each of which, to the extent not inconsistent with the disclosure herein, are incorporated herein by reference.

BACKGROUND

Combustion systems are widely employed throughout society. There is a continual effort to improve the efficiency and reduce harmful emissions of combustion systems.

SUMMARY

Lifting a flame base to provide an increased entrainment length before the onset of combustion has been found by the inventors to reduce oxides of nitrogen (NOx) emissions.

Lifting a flame base while maintaining inherent flame stability has proven challenging.

According to an embodiment, a lifted flame burner includes a primary fuel source configured to support a primary combustion reaction, a secondary fuel source configured to support a secondary combustion reaction, a bluff body configured to hold the secondary combustion reaction, and a lifted flame holder disposed farther away from the primary and secondary fuel sources relative to the bluff body and aligned to be at least partially immersed in the secondary combustion reaction when the secondary combustion reaction is held by the bluff body. An electrically-powered primary combustion reaction actuator is configured to control exposure of a secondary fuel flow from the secondary fuel source to the primary combustion reaction. The electrically-powered primary combustion reaction actuator is configured to reduce or eliminate exposure of the secondary fuel flow to the primary combustion reaction when the electrically-powered primary combustion reaction actuator is activated.

According to another embodiment, a method for operating a lifted flame burner includes supporting a primary combustion reaction to produce an ignition source proximate to a bluff body, providing a secondary fuel stream to impinge on the bluff body, and igniting the secondary fuel stream to produce a secondary combustion reaction. The primary combustion reaction is electrically actuated to remove or reduce effectiveness of the primary combustion reaction as an ignition source proximate to the bluff body. The secondary combustion reaction is allowed to lift and be held by a lifted flame holder. The secondary fuel stream is diluted in a region between the bluff body and the lifted flame holder. Responsive to an interruption in electrical power, the secondary combustion reaction is held by the bluff body.

According to another embodiment, a method for controlling combustion can include selectively applying power to a primary combustion reaction or pilot flame actuator, and selectively applying ignition to a secondary combustion reaction with the primary combustion reaction or pilot flame as a function of the selective application of power to the primary combustion reaction or pilot flame actuator.

According to another embodiment, a combustion control gain apparatus includes a first fuel source configured to support a pilot flame or primary combustion reaction, a pilot flame or primary combustion reaction actuator configured to select a primary combustion reaction or pilot flame deflection, and a secondary fuel source. The pilot flame or primary combustion reaction deflection is selected to control a secondary fuel ignition location.

According to another embodiment, a combustion control gain apparatus includes a first fuel source configured to support a pilot flame or primary combustion reaction, a pilot flame or primary combustion reaction actuator configured to select a primary combustion reaction or pilot flame deflection, and a secondary fuel source. The pilot flame or primary combustion reaction deflection is selected to control a non-ignition location where the secondary fuel is not ignited. A bluff body corresponds to a secondary fuel ignition location when the primary combustion reaction or pilot flame is not deflected. A lifted flame holder corresponds to a secondary fuel ignition location when the primary combustion reaction or pilot flame is deflected.

According to another embodiment, a combustion system includes a primary fuel source configured to support a primary combustion reaction and a secondary fuel source configured to support a secondary combustion reaction. The combustion system includes a bluff body positioned adjacent to the secondary fuel source and a perforated flame holder positioned farther from the secondary fuel source than is the bluff body. The combustion system also includes a combustion reaction actuator configured to selectively cause either the bluff body or the perforated flame holder to hold the secondary combustion reaction by controlling exposure of a flow of the secondary fuel to the primary combustion reaction. The perforated flame holder is positioned to be at least partially immersed in the secondary combustion reaction when the secondary combustion reaction is held by the bluff body.

According to another embodiment, a method for operating a combustion system includes supporting a primary combustion reaction proximate to a bluff body and outputting a secondary fuel stream to impinge on the bluff body. The method includes holding a secondary combustion reaction of the secondary fuel stream with the bluff body by igniting the secondary fuel stream with the primary combustion reaction and holding the secondary combustion reaction with a perforated flame holder positioned downstream of the secondary fuel stream from the bluff body by transferring the secondary combustion reaction from the bluff body to the perforated flame by removing or reducing effectiveness of the primary combustion reaction as an ignition source by electrically actuating the primary combustion reaction.

DETAILED DESCRIPTION

Figure 1A:
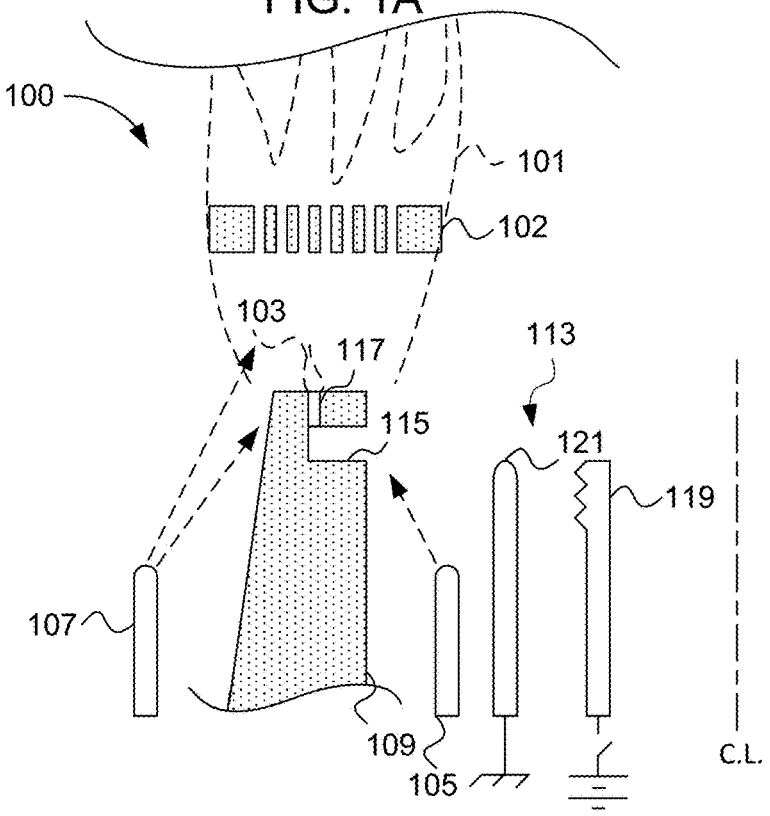
FIG. 1A is a diagram of a burner including a perforated flame holder in a state where a secondary flame is anchored to a bluff body below the perforated flame holder, according to an embodiment.

In the following detailed description, reference is made to the accompanying drawings, which form a part hereof. In the drawings, similar symbols typically identify similar components, unless context dictates otherwise. Other embodiments may be used and/or other changes may be made without departing from the spirit or scope of the disclosure.

Figure 1B:
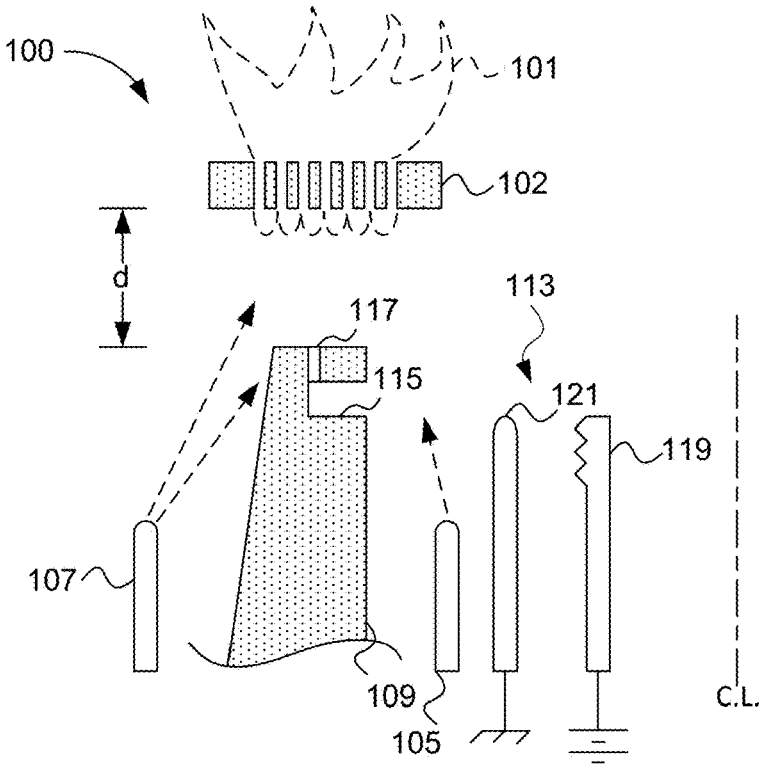
FIG. 1B is a diagram of the burner including the perforated flame holder of FIG. 1A in a state where the secondary flame is anchored to the perforated flame holder above the bluff body, according to an embodiment.

FIG. 1A is a side-sectional diagram of a portion of a combustion system 100 including a perforated flame holder 102 in a state where a secondary flame (also referred to as a secondary combustion reaction) 101 is anchored to a bluff body 109 below the perforated flame holder 102, according to an embodiment. FIG. 1B is a side-sectional diagram of the portion of the burner 100 including the perforated flame holder 102 in a state where the secondary flame 101 is anchored to the perforated flame holder 102 above the bluff body 109, according to an embodiment. In the pictured embodiment, the perforated flame holder 102 and the bluff body 109 are toroidal in shape. Only one side of the burner is shown, the other side being a substantial mirror image.

The combustion system 100 includes a primary fuel source 105 configured to support a primary combustion reaction 103. A secondary fuel source 107 is configured to support a secondary combustion reaction 101, and includes a groove 115 that extends around the inner surface of the bluff body, and a plurality of holes 117 that exit at the top of the bluff body. The bluff body 109 is configured to hold the secondary combustion reaction 101. The perforated flame holder 102 is disposed farther away from the primary and secondary fuel sources 105, 107 relative to the bluff body 109 and aligned to be at least partially immersed in the secondary combustion reaction 101 when the secondary combustion reaction 101 is held by the bluff body 109.

An electrically-powered primary combustion reaction actuator 113 can be configured to control exposure of a secondary fuel flow from the secondary fuel source 107 to the primary combustion reaction 103. The electrically-powered primary combustion reaction actuator 113 can be configured to reduce or eliminate exposure of the secondary fuel flow to the primary combustion reaction 103 when the electrically-powered primary combustion reaction actuator 113 is activated. Similarly, the electrically-powered primary combustion reaction actuator 113 can be configured to cause or increase exposure of the secondary fuel flow to the primary combustion reaction 103 when the electrically-powered primary combustion reaction actuator 113 is not activated. For example, the electrically-powered primary combustion reaction actuator 113 can be configured as an electrically-powered primary combustion reaction deflector 113. The electrically-powered primary combustion reaction deflector 113 is configured to deflect momentum or buoyancy of the primary combustion reaction 103 when the electrically-powered primary combustion reaction deflector 113 is activated.

According to an embodiment, the deflected momentum or buoyancy of the primary combustion reaction 103 caused by the activated primary combustion reaction deflector 113 can be selected to cause the secondary combustion reaction 101 to lift from being held by the bluff body 109 to being held by the perforated flame holder 102. Additionally and/or alternatively, the electrically-powered primary combustion reaction deflector 113 can be configured to deflect the primary combustion reaction 103 away from a stream of secondary fuel output by the secondary fuel source 107 when the electrically-powered primary combustion reaction deflector 113 is activated. The deflection of the primary combustion reaction 103 away from the stream of secondary fuel can be selected to delay ignition of the secondary fuel.

In one embodiment, the perforated flame holder 102 is a lifted flame holder.

In one embodiment, the combustion system 100 is a lifted flame burner.

Figure 2:
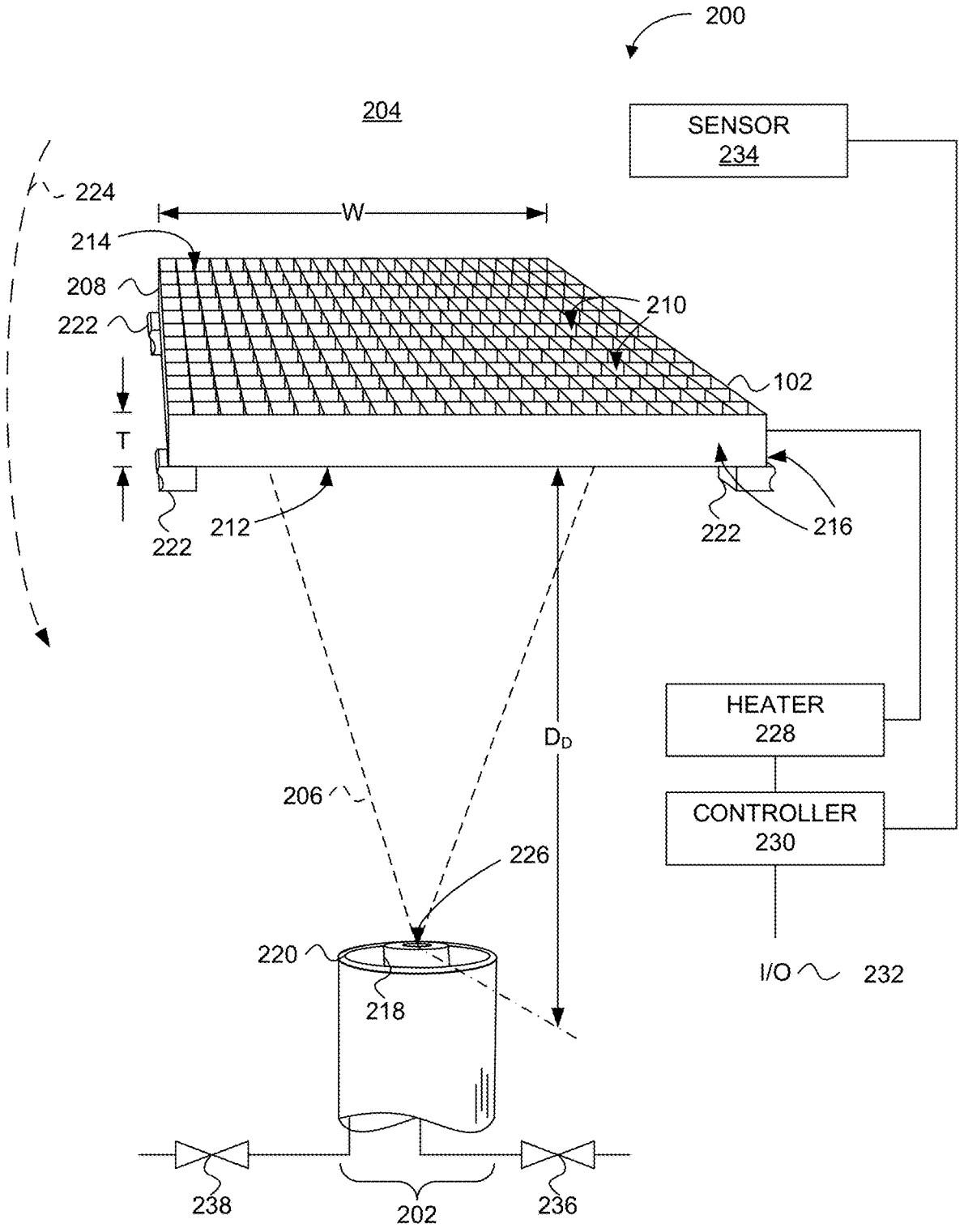
FIG. 2 is a simplified diagram of a burner system including a perforated flame holder configured to hold a combustion reaction, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
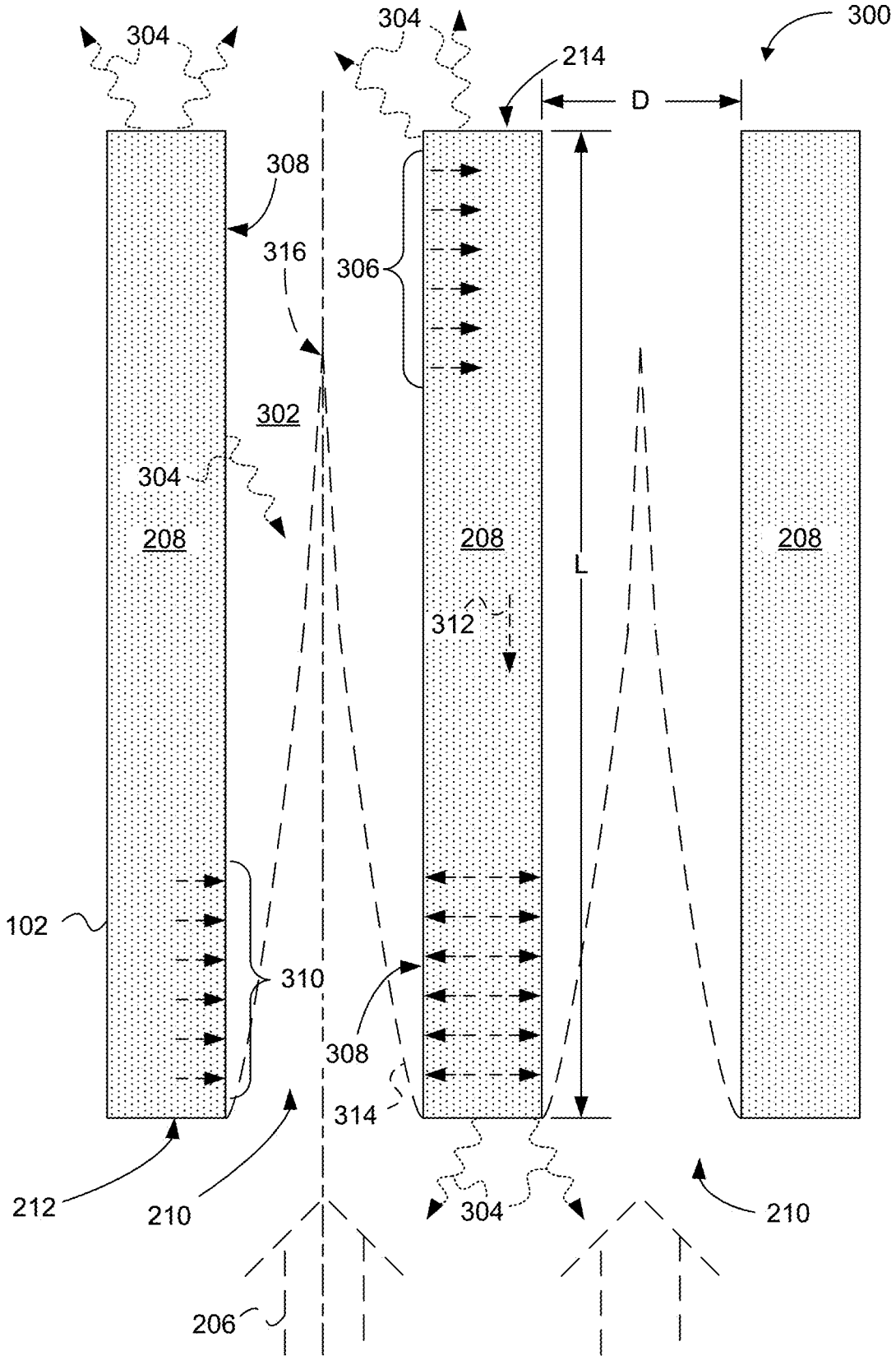
FIG. 3 is a side sectional diagram of a portion of the perforated flame holder of FIGS. 1 and 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 208 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
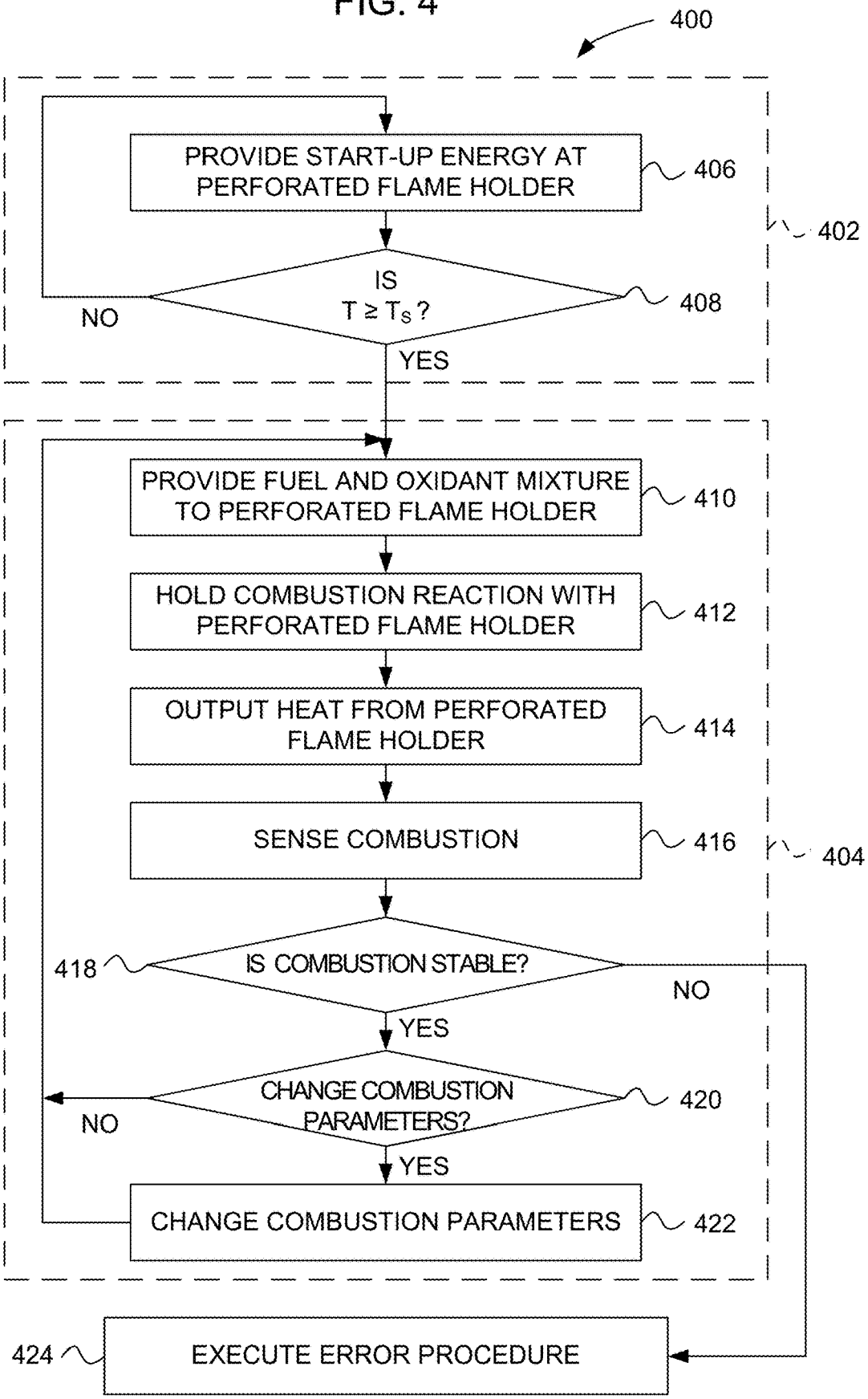
FIG. 4 is a flow chart showing a method for operating a burner system, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body 109 configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper to control a preheat flame type of heater 228 to heat the perforated flame holder 102 to an operating temperature. The controller 230 can similarly control the fuel control valve 236 and/or the oxidant blower or damper to change the fuel and oxidant mixture 206 flow responsive to a heat demand change received as data via the data interface 232.

Figure 5A:
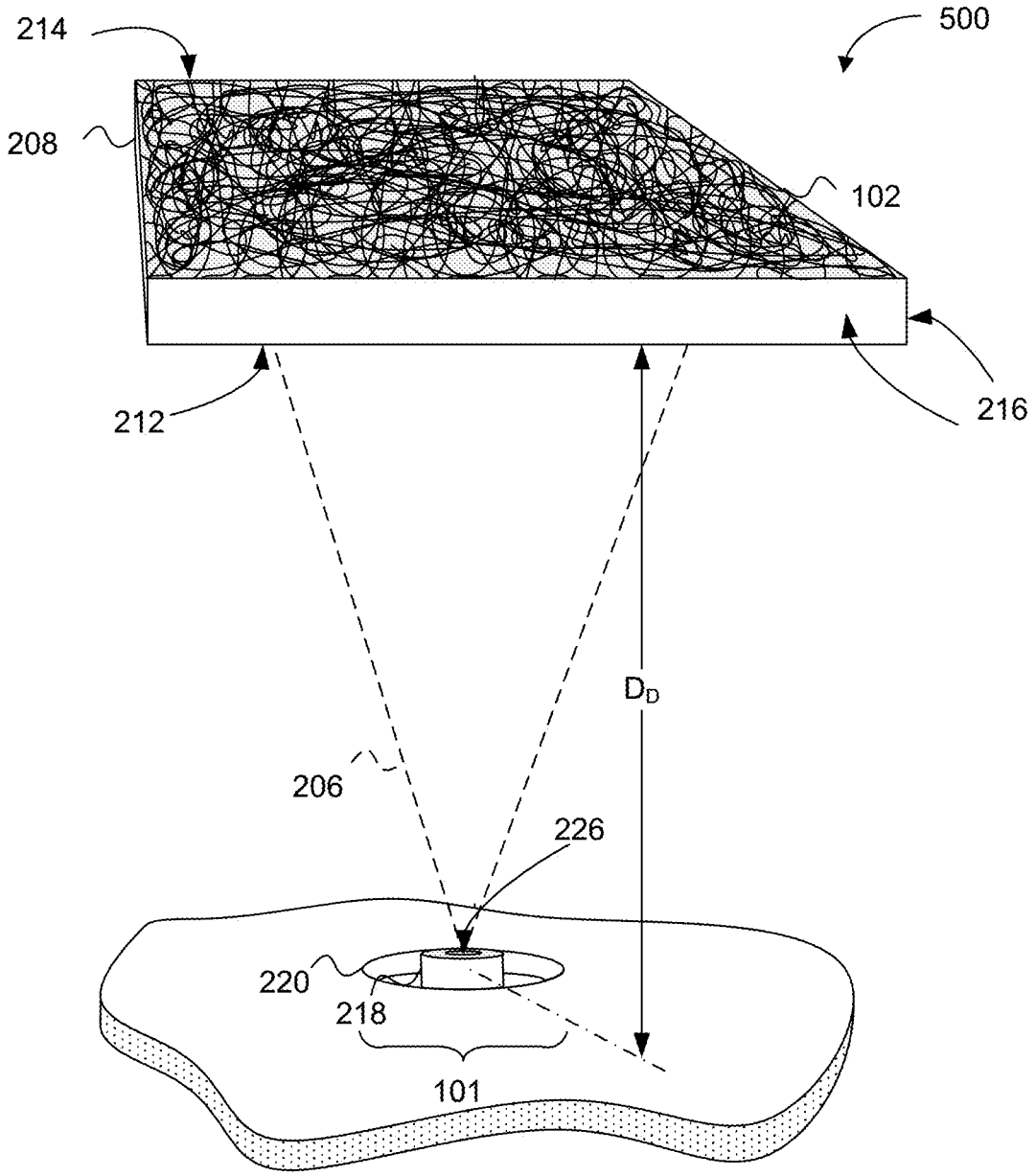
FIG. 5A is a simplified perspective view of a combustion system, including another alternative perforated flame holder, according to an embodiment.
Figure 5B:
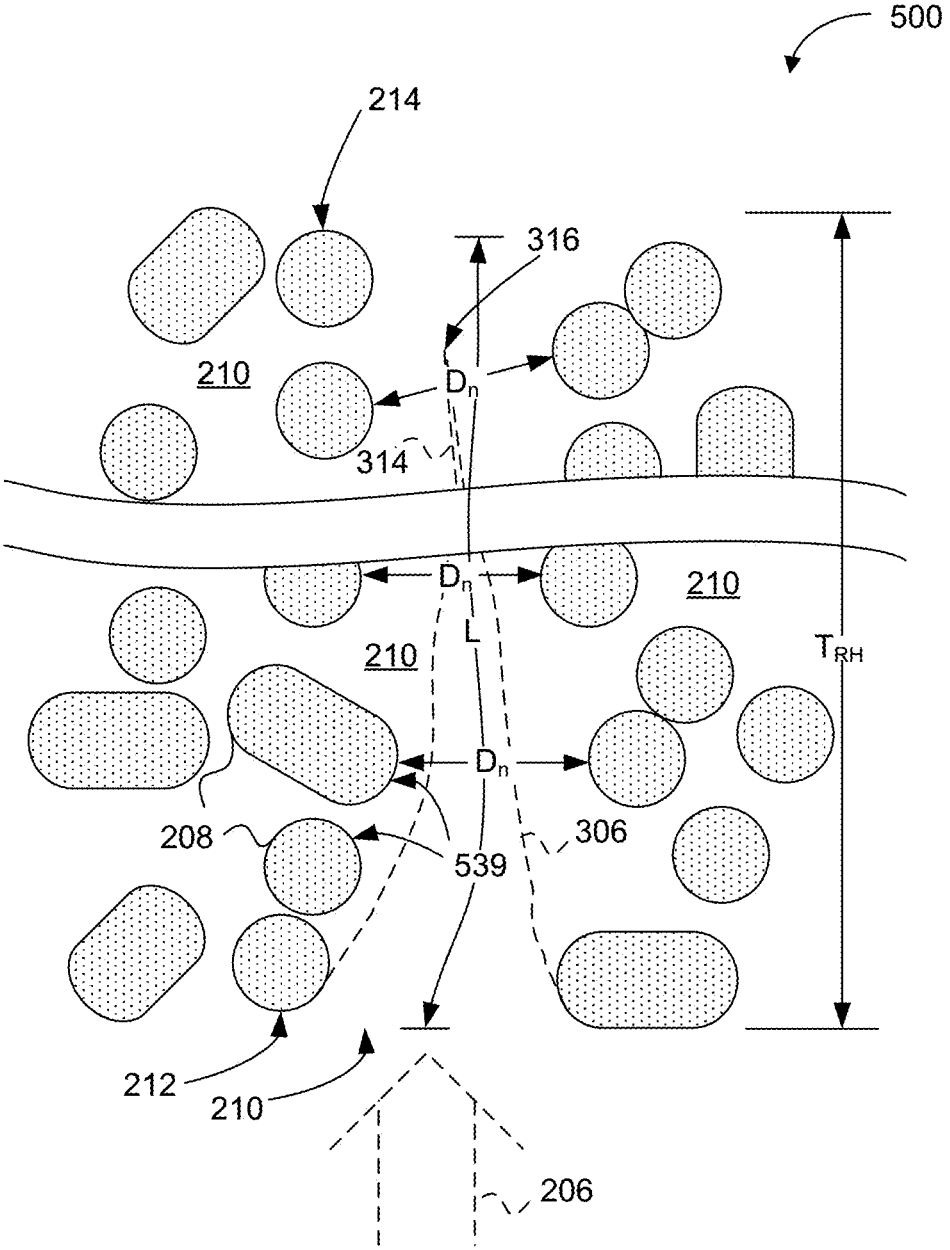
FIG. 5B is a simplified side sectional diagram of a portion of the reticulated ceramic perforated flame holder of FIG. 5A, according to an embodiment.

FIG. 5A is a simplified perspective view of a combustion system 500, including another alternative perforated flame holder 102, according to an embodiment. The perforated flame holder 102 is a reticulated ceramic perforated flame holder, according to an embodiment. FIG. 5B is a simplified side sectional diagram of a portion of the reticulated ceramic perforated flame holder 102 of FIG. 5A, according to an embodiment. The perforated flame holder 102 of FIGS. 5A, 5B can be implemented in the various combustion systems described herein, according to an embodiment. The perforated flame holder 102 is configured to support a combustion reaction of the fuel and oxidant 206 at least partially within the perforated flame holder 102. According to an embodiment, the perforated flame holder 102 can be configured to support a combustion reaction of the fuel and oxidant 206 upstream, downstream, within, and adjacent to the reticulated ceramic perforated flame holder 102.

According to an embodiment, the perforated flame holder body 208 can include reticulated fibers 539. The reticulated fibers 539 can define branching perforations 210 that weave around and through the reticulated fibers 539. According to an embodiment, the perforations 210 are formed as passages through the reticulated ceramic fibers 539.

According to an embodiment, the reticulated fibers 539 can include alumina silicate. According to an embodiment, the reticulated fibers 539 can be formed from extruded mullite or cordierite. According to an embodiment, the reticulated fibers 539 can include Zirconia. According to an embodiment, the reticulated fibers 539 can include silicon carbide.

The term "reticulated fibers" refers to a netlike structure. According to an embodiment, the reticulated fibers 539 are formed from an extruded ceramic material. In reticulated fiber embodiments, the interaction between the fuel and oxidant 206, the combustion reaction, and heat transfer to and from the perforated flame holder body 208 can function similarly to the embodiment shown and described above with respect to FIGS. 2-4. One difference in activity is a mixing between perforations 210, because the reticulated fibers 539 form a discontinuous perforated flame holder body 208 that allows flow back and forth between neighboring perforations 210.

According to an embodiment, the reticulated fiber network is sufficiently open for downstream reticulated fibers 539 to emit radiation for receipt by upstream reticulated fibers 539 for the purpose of heating the upstream reticulated fibers 539 sufficiently to maintain combustion of a fuel and oxidant 206. Compared to a continuous perforated flame holder body 208, heat conduction paths 312 between fibers 539 are reduced due to separation of the fibers 539. This may cause relatively more heat to be transferred from the heat-receiving region 306 (heat receiving area) to the heat-output region 310 (heat output area) of the reticulated fibers 539 via thermal radiation.

According to an embodiment, individual perforations 210 may extend from an input face 212 to an output face 214 of the perforated flame holder 102. Perforations 210 may have varying lengths L. According to an embodiment, because the perforations 210 branch into and out of each other, individual perforations 210 are not clearly defined by a length L.

According to an embodiment, the perforated flame holder 102 is configured to support or hold a combustion reaction or a flame at least partially between the input face 212 and the output face 214. According to an embodiment, the input face 212 corresponds to a surface of the perforated flame holder 102 proximal to the fuel nozzle 218 or to a surface that first receives fuel. According to an embodiment, the input face 212 corresponds to an extent of the reticulated fibers 539 proximal to the fuel nozzle 218. According to an embodiment, the output face 214 corresponds to a surface distal to the fuel nozzle 218 or opposite the input face 212. According to an embodiment, the input face 212 corresponds to an extent of the reticulated fibers 539 distal to the fuel nozzle 218 or opposite to the input face 212.

According to an embodiment, the formation of boundary layers 314, transfer of heat between the perforated reaction holder body 208 and the gases flowing through the perforations 210, a characteristic perforation width dimension D, and the length L can be regarded as related to an average or overall path through the perforated reaction holder 102. In other words, the dimension D can be determined as a root-mean-square of individual Dn values determined at each point along a flow path. Similarly, the length L can be a length that includes length contributed by tortuosity of the flow path, which may be somewhat longer than a straight line distance $T_{RH}$ from the input face 212 to the output face 214 through the perforated reaction holder 102. According to an embodiment, the void fraction (expressed as (total perforated reaction holder 102 volume−fiber 539 volume)/total volume)) is about 70%.

According to an embodiment, the reticulated ceramic perforated flame holder 102 is a tile about 1"×4"×4". According to an embodiment, the reticulated ceramic perforated flame holder 102 includes about 10 pores per square inch of surface area. Other materials and dimensions can also be used for a reticulated ceramic perforated flame holder 102 in accordance with principles of the present disclosure.

According to an embodiment, the reticulated ceramic perforated flame holder 102 can include shapes and dimensions other than those described herein. For example, the perforated flame holder 102 can include reticulated ceramic tiles that are larger or smaller than the dimensions set forth above. Additionally, the reticulated ceramic perforated flame holder 102 can include shapes other than generally cuboid shapes.

According to an embodiment, the reticulated ceramic perforated flame holder 102 can include multiple reticulated ceramic tiles. The multiple reticulated ceramic tiles can be joined together such that each ceramic tile is in direct contact with one or more adjacent reticulated ceramic tiles. The multiple reticulated ceramic tiles can collectively form a single perforated flame holder 102. Alternatively, each reticulated ceramic tile can be considered a distinct perforated flame holder 102.

Figure 6:
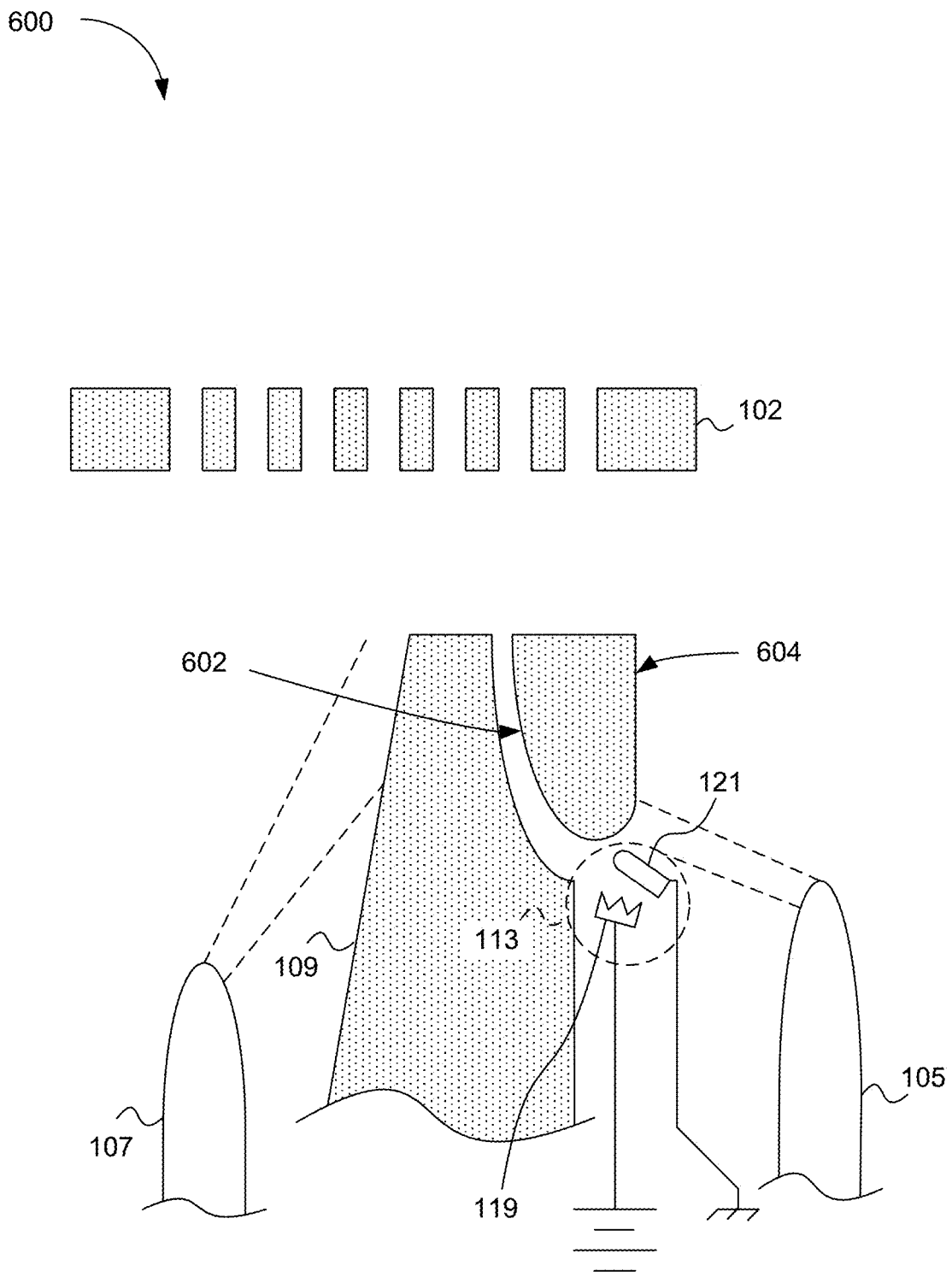
FIG. 6 is a side-sectional diagram of a burner including coanda surfaces along which a primary combustion reaction may flow responsive to deflection or non-deflection of the primary combustion reaction, according to an embodiment.

FIG. 6 is a side-sectional diagram of a burner 600 including coanda surfaces 602, 604 along which a primary combustion reaction can flow, according to an embodiment. The burner 600 includes a bluff body 109. The bluff body 109 includes the two coanda surfaces 602, 604.

A primary fuel source 105 is aligned to cause the primary combustion reaction to occur substantially along the first coanda surface 602 when the electrically-powered primary combustion reaction deflector 113 is not activated. The electrically-powered primary combustion reaction deflector 113 is configured to cause the primary combustion reaction to occur substantially along the second coanda surface 604 when the electrically-powered primary combustion reaction deflector 113 is activated.

According to an embodiment, the first coanda surface 602 is aligned to cause the primary combustion reaction to cause ignition of the secondary fuel substantially coincident with the bluff body 109. The second coanda surface 604 is aligned to cause the primary combustion reaction to cause ignition of the secondary fuel between the bluff body 109 and the perforated flame holder 102. Additionally, or alternatively, the second coanda surface 604 can be aligned to cause the primary combustion reaction to cause ignition of the secondary fuel substantially coincident with the perforated flame holder 102. Additionally or alternatively, the second coanda surface 604 can be aligned to cause the primary combustion reaction or products from the primary combustion reaction to combine with the secondary combustion reaction 101 without causing ignition of the secondary combustion reaction 101.

Referring to FIGS. 1A, 1B, and 6, the electrically-powered primary combustion reaction deflector 113 can include an ionic wind device (as illustrated). The ionic wind device includes a charge-ejecting electrode such as a corona electrode (also referred to as a serrated electrode) 119. According to an embodiment, the serrated electrode 119 is configured to be held at between 15 kilovolts and 50 kilovolts when the electrically-powered primary combustion reaction deflector 113 is activated. The ionic wind device also includes a smooth electrode 121. The smooth electrode 121 is configured to be held at or near electrical ground (at least) when the electrically-powered primary combustion reaction deflector 113 is activated. The ionic wind device is preferably disposed in a region of space characterized by a temperature below the primary combustion reaction temperature. Keeping the ambient temperature around or the surface temperature of the charge-ejecting electrode 119 relatively low was found by the inventors to improve the rate of charge ejection at a given voltage. The charge ejection voltage can be determined according to Peek's Law.

A lifting distance d from the bluff body 109 to at least a portion of the perforated flame holder 102 can be selected to cause partial premixing of the secondary combustion reaction 101 when the secondary combustion reaction 101 is held by the perforated flame holder 102. The lifting distanced from the bluff body 109 to at least a portion of the perforated flame holder 102 can be selected to cause the combination of the primary combustion reaction and the secondary combustion reaction 101 to output reduced oxides of nitrogen (NOx) when the secondary combustion reaction 101 is held by the perforated flame holder 102. For example, the lifting distanced can be selected to cause the stream of secondary fuel output by the secondary fuel source 107 to entrain sufficient air to result in the secondary combustion reaction 101 being at about 1.3 to 1.5 times a stoichiometric ratio of oxygen-to-fuel.

According to an embodiment, the lifting distance d can be about 4.25 inches. Greater lifting distance d can optionally be selected by providing a perforated flame holder support structure (not shown) configured to hold the perforated flame holder 102 at a greater height above the bluff body 109. The perforated flame holder support structure can itself be supported from the bluff body 109 or a furnace floor (not shown).

According to an embodiment, the electrically-powered primary combustion reaction actuator 113 is configured to cause the secondary flame 101 to be reduced in height when the electrically-powered primary combustion reaction actuator 113 is activated compared to the secondary flame 101 height when the electrically-powered primary combustion reaction actuator 113 is not activated.

The primary fuel nozzle 105 is aligned to cause the secondary combustion reaction 101 to be ignited by the primary combustion reaction when the primary combustion reaction actuator 113 is not actuated. The primary fuel combustion reaction can be held by the bluff body 109 when the electrical power is turned off or fails.

In other words, according to this embodiment, as long as electrical power is present in the system, the primary combustion reaction deflector 113 remains energized and operates to prevent the primary combustion reaction 103 from igniting the secondary combustion reaction 101 in the region of the bluff body 109. This permits the secondary combustion reaction 101 to be held instead by the perforated flame holder 102. However, in the event of a loss of power, the primary combustion reaction deflector 113 no longer acts on the primary combustion reaction 103, which, because of the alignment of the primary fuel nozzle 105 ignites the fuel from the secondary fuel source 107 and causing the secondary combustion reaction 101 to be held by the bluff body 109.

Figure 7:
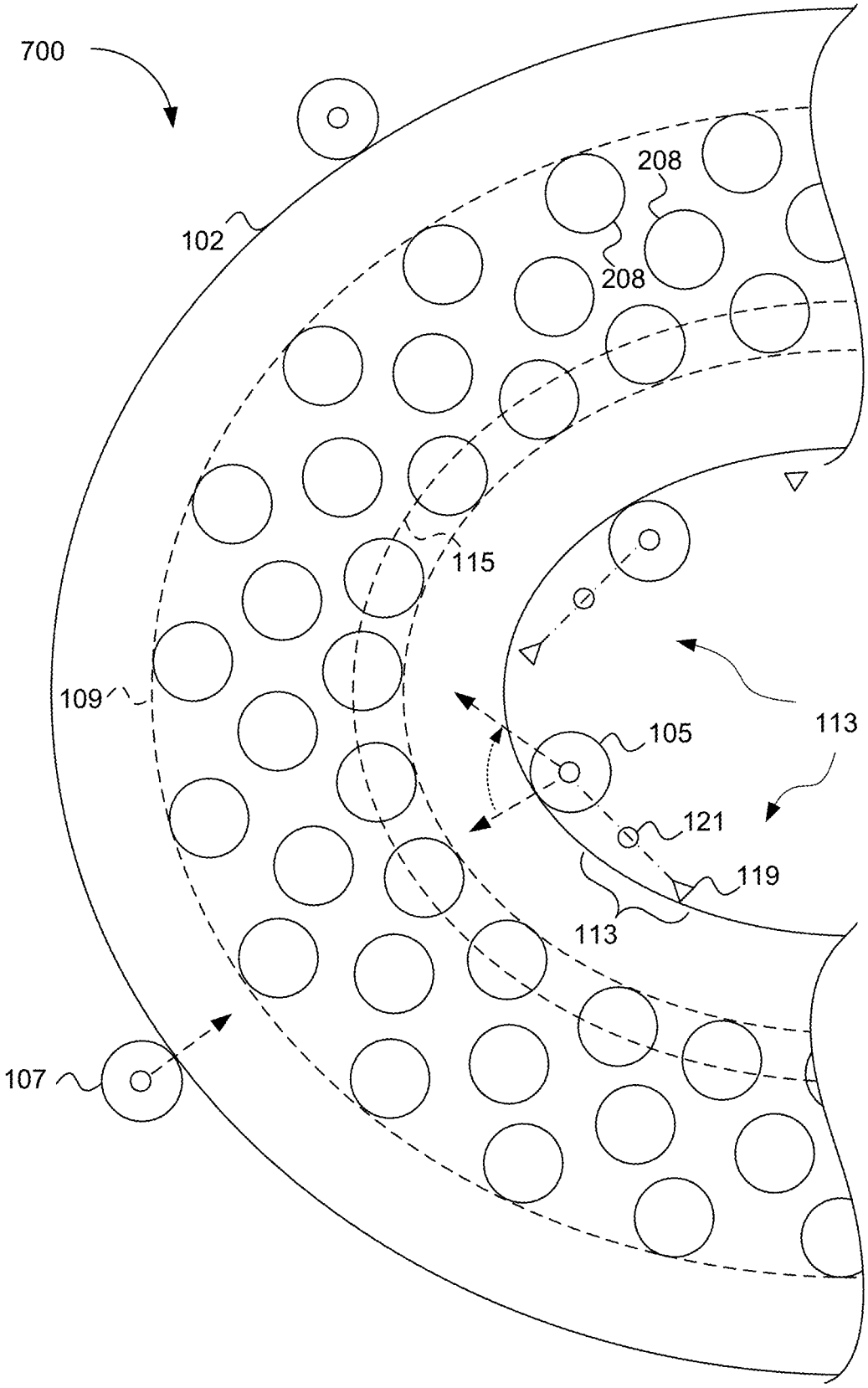
FIG. 7 is a top view of a burner including a perforated flame holder wherein a primary combustion reaction actuator includes an ionic wind device, according to an embodiment.

FIG. 7 is a top view of a burner 700 including a perforated flame holder 102, a bluff body 109—positioned behind the perforated flame holder 102 in the view of FIG. 7 and shown in hidden lines—and a primary combustion reaction deflector 113 that includes an ionic wind device, according to an embodiment. The perforated flame holder 102 and the bluff body 109 can each have a toroid shape, a portion of which is shown in FIG. 7. The ionic wind device includes a charge ejecting electrode (such as a serrated electrode) 119 configured to be held at a high voltage and a smooth electrode 121 configured to be held at or near voltage ground. The serrated electrode 119 and the smooth electrode 121 define a line or a plane that intersects the primary fuel source 105. When energized, the charge ejecting electrode 119 ejects ions that are strongly attracted toward the counter-charged smooth electrode 121. Ions moving from the charge electrode 119 toward the smooth electrode 121 entrain air, which moves along the same path. Although most of the ions contact the smooth electrode 121 and discharge, the entrained air, i.e., ionic wind, continues along the same path toward the primary fuel source 105 and the primary combustion reaction 103 supported thereby. The primary combustion reaction 103 is in turn entrained or carried by the movement of air to circulate in a groove 115 formed in an interior surface of the toroidal bluff body 109, preventing the primary combustion reaction 103 from entering holes in the bluff body 109. When power is removed from the ionic wind device, the primary combustion reaction 103 is no longer deflected by air moving laterally along the bluff body 109, and is thus permitted to emerge through a plurality of holes 117 in a top surface of the bluff body 109 when the electrically-powered primary combustion reaction deflector 113 is not activated.

The burner 700 includes a plurality of primary fuel sources 105, secondary fuel sources 107, and primary combustion reaction deflectors 113 distributed evenly around the bluff body 109, as shown in part in FIG. 7. The pluralities of elements are preferably configured to operate in concert with each other, for more effective operation. For example, each of the primary combustion reaction deflectors 113 is oriented in the same direction (facing clockwise, as viewed from above in the example of FIG. 3), and energized simultaneously. Thus, air movement in the groove 115 produced by an ionic wind generated by one of the plurality of primary combustion reaction deflectors 113 reinforces air movement generated by others of the plurality, which increases the effectiveness of each of the devices.

Figure 8:
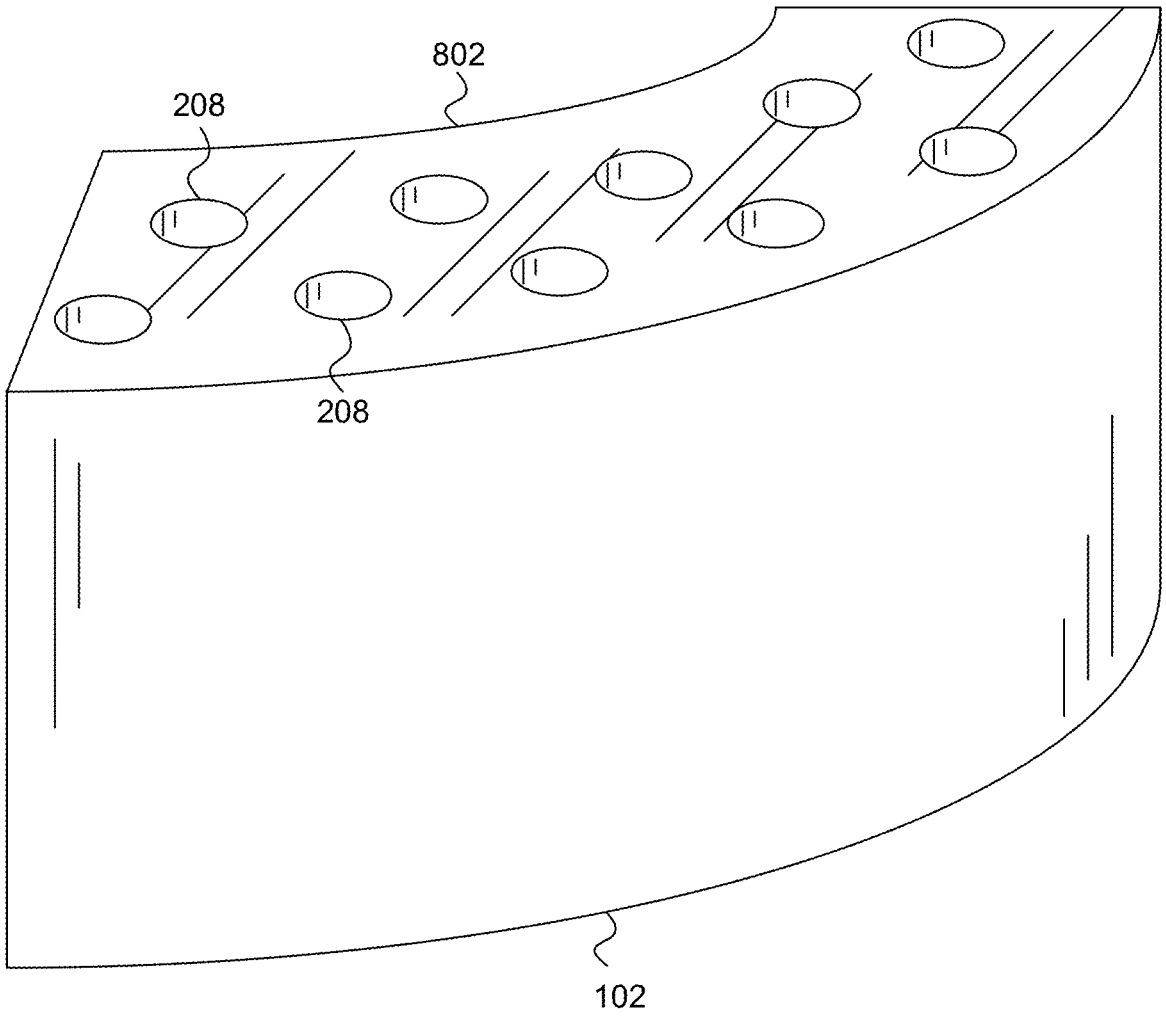
FIG. 8 is a diagram of a perforated flame holder, according to an embodiment.

FIG. 8 is a diagram of a perforated flame holder 102, according to an embodiment. The perforated flame holder 102 of FIG. 8 includes a volume of refractory material 802. The volume of refractory material 802 can be selected to allow the secondary combustion reaction 101 to occur at least partially within a plurality of partially bounded passages 208 extending through the flame holder 102. The plurality of partially bounded passages 208 includes a plurality of vertically-aligned cylindrical voids through the refractory material 802. The refractory material 802 can be formed in a toric shape or as a section of a toric shape (as shown), for example. The perforated flame holder 102 can be about two to three inches thick, for example. The bounded passages 208 were formed by drilling the cylindrical voids through the refractory material. The inventors used drill bits ranging from ⅜ inch to about ¾ inch to drill the cylindrical voids, according to various embodiments. The inventors contemplate various alternative ways to form the perforated flame holder 102 and the cylindrical voids. For example, the cylindrical voids can be cast in place.

Figure 9:
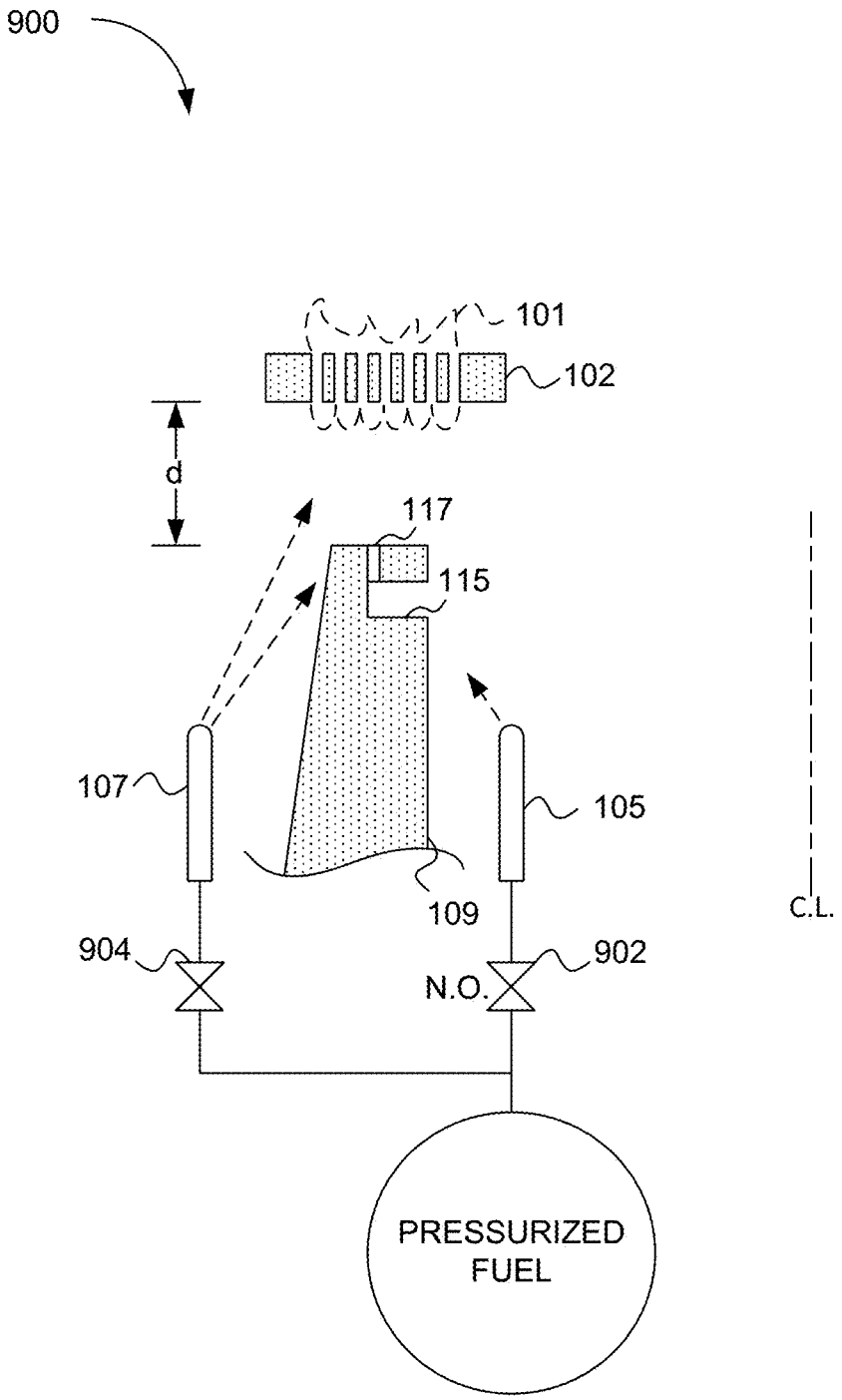
FIG. 9 is a diagram of a burner including a perforated flame holder, according to another embodiment.

FIG. 9 is a diagram of a burner 900 that includes a perforated flame holder 102, according to an embodiment. According to the embodiment, the electrically-powered primary combustion reaction actuator 113 includes a primary combustion reaction control valve 902 and a secondary combustion reaction control valve 904. The primary combustion reaction control valve 902 is preferably configured as a normally-open valve that is actuated to a reduced flow rate when electrical power is applied to the control valve 902. Optionally, the primary combustion reaction control valve 902 can be closed when the secondary combustion reaction 101 is held by the perforated flame holder 102.

Figure 10:
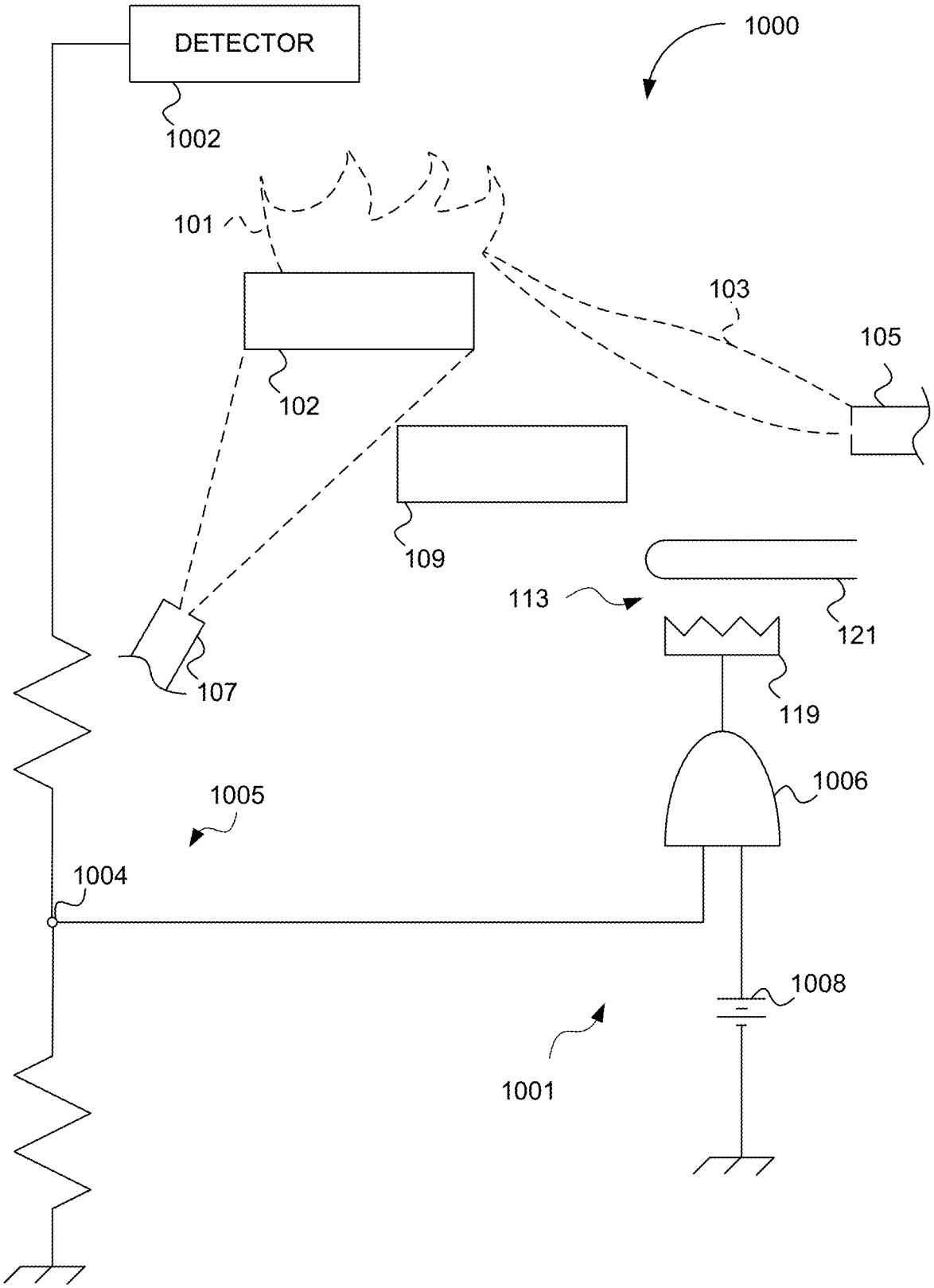
FIG. 10 is a block diagram of a burner including a perforated flame holder and a feedback circuit configured to sense operation of the perforated flame holder, according to an embodiment.

FIG. 10 is a block diagram of a burner 1000 including a perforated flame holder 102 and a feedback circuit 1001 configured to sense operation of the perforated flame holder 102, according to an embodiment. The feedback circuit 1001 is configured to sense the presence or absence of a secondary combustion reaction 101 at the perforated flame holder 102. The feedback circuit 1001 is configured to interrupt electrical power to the electrically-actuated primary combustion reaction 103 when the secondary combustion reaction 101 is not held by the perforated flame holder 102. Additionally, and/or alternatively, the feedback circuit 1001 can be configured to interrupt electrical power to the electrically-powered primary combustion reaction actuator 113 when the perforated flame holder 102 is damaged or fails.

According to an embodiment, the feedback circuit 1001 includes a detection electrode 1002. The detection electrode 1002 is configured to receive an electrical charge imparted onto the secondary combustion reaction 101 by the electrically-powered primary combustion reaction actuator 113 and/or a combustion reaction charge source, and to produce a voltage signal that corresponds to a value of the received charge. A node 1004 of a voltage divider 1005 is operatively coupled to the detection electrode 1002, and is configured to provide a voltage that is proportional to the voltage signal produced by the detector 1002, which is thus indicative of the presence or absence of a secondary combustion reaction 101 held by the perforated flame holder 102.

A logic circuit 1006 is operatively coupled to the node 1004, and is configured to cause application of a voltage from a voltage source 1008 to the primary combustion reaction actuator 113 while a voltage signal is present at the node 1004. A loss of the voltage signal from the detection electrode 1002 causes the voltage at the node 1004 to drop, in response to which the logic circuit 1006 interrupts electrical power to the electrically-powered primary combustion reaction actuator 113. The actuator 113, in turn, stops deflecting the primary combustion reaction 103, which begins to ignite the secondary combustion reaction 101 at the bluff body 109.

Figure 11:
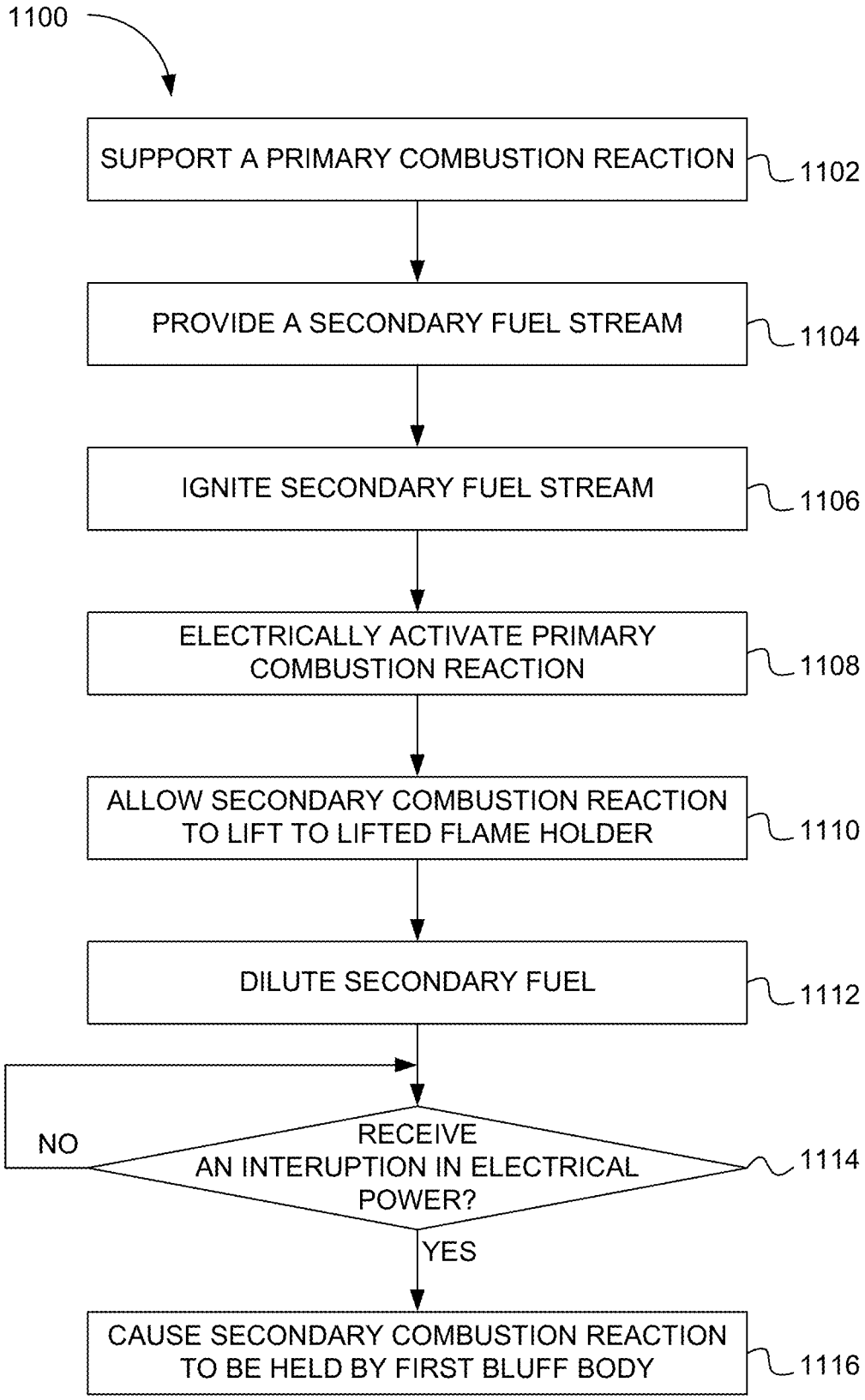
FIG. 11 is a flow chart depicting a method for operating a burner including a primary combustion reaction actuator configured to select a secondary combustion location, according to an embodiment.

FIG. 11 is a flow chart depicting a method 1100 for operating a burner including a primary combustion reaction actuator configured to select a secondary combustion location, according to an embodiment.

The method 1100 for operating a combustion system can include step 1102, in which a primary combustion reaction is supported to produce an ignition source proximate to a bluff body. In step 1104, a secondary fuel stream is provided to impinge on the bluff body. Proceeding to step 1106, the secondary fuel stream is ignited to produce a secondary combustion reaction. In step 1108, the primary combustion reaction is electrically actuated to remove or reduce effectiveness of the primary combustion reaction as an ignition source proximate to the bluff body. Proceeding to step 1110, the secondary combustion is allowed to lift and be held by a perforated flame holder.

In step 1112, the secondary fuel stream is diluted in a region between the bluff body and the perforated flame holder. Diluting the secondary fuel stream in the region between the bluff body and the perforated flame holder can cause the lifted secondary combustion reaction to occur at a lower temperature than the secondary combustion reaction held by the bluff body. Additionally and/or alternatively, diluting the secondary fuel stream in the region between the bluff body and the perforated flame holder can cause the lifted secondary combustion reaction to output reduced oxides of nitrogen (NOx) compared to the secondary combustion reaction when held by the bluff body. Diluting the secondary fuel stream in the region between the bluff body and the perforated flame holder can also cause the lifted secondary combustion reaction to react to substantial completion within a reduced overall secondary combustion flame height, as compared to the secondary combustion reaction when held by the bluff body.

Referring to step 1108, in which the primary combustion reaction is electrically actuated to remove or reduce effectiveness of the primary combustion reaction as an ignition source proximate to the bluff body, step 1108 can include deflecting the primary combustion reaction. The primary combustion reaction can be deflected, for example, with an ionic wind generator.

Deflecting the primary combustion reaction with an ionic wind generator can include moving the primary combustion reaction from a first coanda surface to a second coanda surface. Additionally and/or alternatively, deflecting the primary combustion reaction with an ionic wind generator can include directing the primary combustion reaction along a groove in the bluff body. Deflecting the primary combustion reaction with an ionic wind generator preferably includes reducing output of the primary combustion reaction through holes formed in the bluff body.

Referring to step 1108, removing or reducing effectiveness of the primary combustion reaction as an ignition source proximate to the bluff body can include reducing fuel flow to the primary combustion reaction.

The method 1100 can include step 1114, in which an interruption in electrical power to the primary combustion reaction actuator is received. Proceeding to step 1116, in response to the interruption in electrical power, the secondary combustion reaction is caused to be held by the bluff body.

Referring to FIGS. 1A-7, the method 1100 for controlling combustion can include selectively applying power to a primary combustion reaction or pilot flame actuator 113. Additionally and/or alternatively, the method 1100 can include selectively applying ignition to a secondary combustion reaction 101 with the primary combustion reaction 103 or pilot flame as a function of the selective application of power to the primary combustion reaction 103 or pilot flame actuator 113.

According to an embodiment, a combustion control gain apparatus can include a first fuel source 105. The first fuel source 105 may be configured to support a pilot flame or primary combustion reaction 103.

The combustion control gain apparatus includes a pilot flame or a primary combustion reaction actuator 113. The pilot flame or primary combustion reaction actuator 113 is configured to select a primary combustion reaction or pilot flame deflection 113. Additionally, a secondary fuel source 107 is included. The pilot flame or primary combustion reaction deflection 113 is selected to control a secondary fuel ignition location.

Additionally and/or alternatively, the pilot flame or primary combustion reaction deflection 113 can be selected to control a non-ignition location where the secondary fuel is not ignited.

A bluff body 109 can include a secondary fuel ignition location when the primary combustion reaction or pilot flame 103 is not deflected.

A perforated flame holder 102 can correspond to a secondary fuel ignition location when the primary combustion reaction or pilot flame 103 is deflected.

According to an embodiment, a method for operating a combustion system includes supporting a primary combustion reaction proximate to a bluff body and outputting a secondary fuel stream to impinge on the bluff body. The method includes holding a secondary combustion reaction of the secondary fuel stream with the bluff body by igniting the secondary fuel stream with the primary combustion reaction and holding the secondary combustion reaction with a perforated flame holder positioned downstream of the secondary fuel stream from the bluff body by transferring the secondary combustion reaction from the bluff body to the perforated flame by removing or reducing effectiveness of the primary combustion reaction as an ignition source by electrically actuating the primary combustion reaction.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A combustion system, comprising:

a primary fuel source configured to support a primary combustion reaction;

a secondary fuel source configured to support a secondary combustion reaction;

a bluff body positioned adjacent to the secondary fuel source;

a perforated flame holder positioned farther from the secondary fuel source than is the bluff body; and a combustion reaction actuator configured to selectively cause either the bluff body or the perforated flame holder to hold the secondary combustion reaction by controlling exposure of a flow of a secondary fuel to the primary combustion reaction, the perforated flame holder being positioned to be at least partially immersed in the secondary combustion reaction when the secondary combustion reaction is held by the bluff body;

wherein the combustion reaction actuator includes a primary combustion reaction control valve.

2. A combustion system, comprising:

a primary fuel source configured to support a primary combustion reaction;

a secondary fuel source configured to support a secondary combustion reaction;

a bluff body positioned adjacent to the secondary fuel source;

a perforated flame holder positioned farther from the secondary fuel source than is the bluff body; and a combustion reaction actuator configured to selectively cause either the bluff body or the perforated flame holder to hold the secondary combustion reaction by controlling exposure of a flow of the secondary fuel to the primary combustion reaction, the perforated flame holder being positioned to be at least partially immersed in the secondary combustion reaction when the secondary combustion reaction is held by the bluff body;

wherein the perforated flame holder is a reticulated ceramic perforated flame holder.

3. The combustion system of claim 2, wherein the perforated flame holder includes a plurality of reticulated fibers.

4. The combustion system of claim 3, wherein the perforated flame holder includes zirconia.

5. The combustion system of claim 3, wherein the perforated flame holder includes alumina silicate.

6. The combustion system of claim 3, wherein the perforated flame holder includes silicon carbide.

7. The combustion system of claim 3, wherein the reticulated fibers are formed from extruded mullite.

8. The combustion system of claim 3, wherein the reticulated fibers are formed from cordierite.

9. The combustion system of claim 3, wherein the perforated flame holder is configured to hold the secondary combustion reaction upstream, downstream, and within the perforated flame holder.

10. The combustion system of claim 3, wherein the perforated flame holder includes about 10 pores per square inch of surface area.

11. The combustion system of claim 3, wherein the perforated flame holder includes a plurality of perforations formed as passages between the reticulated fibers.

12. The combustion system of claim 11, wherein the perforations are branching perforations.

13. The combustion system of claim 11, wherein the perforated flame holder includes an input face proximal to the second fuel source and an output face distal to the secondary fuel source.

14. The combustion system of claim 13, wherein the perforations extend between the input face and the output face.

15. The combustion system of claim 13, wherein the input face corresponds to an extent of the reticulated fibers proximal to the secondary fuel source.

16. The combustion system of claim 15, wherein the output face corresponds to an extent of the reticulated fibers distal to the secondary fuel source.

17. The combustion system of claim 13, wherein the perforated flame holder is configured to support at least a portion of the secondary combustion reaction within the perforations between the input face and the output face.

18. The combustion system of claim 1, wherein, when activated, the combustion reaction actuator is configured to reduce or eliminate exposure of the secondary fuel flow to the primary combustion reaction.

19. The combustion system of claim 18, wherein the combustion reaction actuator is configured to reduce or eliminate exposure of the secondary fuel flow to the primary combustion reaction only when activated.

20. The combustion system of claim 1, wherein the combustion reaction actuator includes a combustion reaction deflector configured to deflect momentum of the primary combustion reaction when the combustion reaction deflector is activated.

21. The combustion system of claim 20, wherein the deflection of momentum of the primary combustion reaction by the combustion reaction deflector is sufficient to cause the secondary combustion reaction to lift from being held by the bluff body to being held by the perforated flame holder.

22. The combustion system of claim 20, wherein the combustion reaction deflector is configured to deflect the primary combustion reaction away from a stream of the secondary fuel when the combustion reaction deflector is activated.

23. The combustion system of claim 22, wherein deflection of the primary combustion reaction away from the stream of secondary fuel output delays ignition of the secondary fuel and oxidant.

24. The combustion system of claim 20, wherein the bluff body includes two coanda surfaces;

wherein the primary fuel source is aligned to cause the primary combustion reaction to occur substantially along the first coanda surface; and wherein the combustion reaction deflector is configured to disable occurrence of the primary combustion reaction substantially along the first coanda surface, and to cause the primary combustion reaction to occur substantially along the second coanda surface when the combustion reaction deflector is activated.

25. The combustion system of claim 24 wherein the first coanda surface is aligned such that when the primary combustion reaction occurs along the first coanda surface, the primary combustion reaction ignites a stream of fuel output by the secondary fuel source substantially coincident with the bluff body.

26. The combustion system of claim 24, wherein the second coanda surface is aligned to cause the primary combustion reaction to ignite a stream of fuel output by the secondary fuel source between the bluff body and the perforated flame holder.

27. The combustion system of claim 24, wherein the second coanda surface is aligned to cause the primary combustion reaction to ignite a stream of the secondary fuel coincident with the perforated flame holder.

28. The combustion system of claim 20, wherein the combustion reaction deflector comprises an ionic wind device.

29. The combustion system of claim 28, wherein the ionic wind device includes a serrated electrode configured to be held at 15 kilovolts to 50 kilovolts when the combustion reaction deflector is activated.

30. The combustion system of claim 28, wherein the ionic wind device includes a smooth electrode configured to be held near ground when the combustion reaction deflector is activated.

31. The combustion system of claim 28, wherein the ionic wind device is disposed in a region of space characterized by a temperature below that of the primary combustion reaction.

32. The combustion system of claim 28, wherein the ionic wind device further comprises:

a serrated electrode configured to be held at a high voltage; and a smooth electrode configured to be held at or near voltage ground; and wherein the serrated electrode and the smooth electrode define a line or a plane that also intersects the primary fuel source.

33. The combustion system of claim 20, wherein the combustion reaction deflector is configured to cause the primary combustion reaction to circulate in a groove when the combustion reaction deflector is activated.

34. The combustion system of claim 20, wherein the bluff body is configured to direct the primary combustion reaction to emerge through a plurality of holes in a top surface of the bluff body.

35. The combustion system of claim 1, wherein the primary combustion reaction control valve includes a normally-open valve that is configured to actuate to a reduced flow rate when electrical power is applied to the control valve.

36. The combustion system of claim 1, wherein a distance between the bluff body and the perforated flame holder is sufficient to enable partial premixing of a stream of fuel output by the secondary fuel source when the secondary combustion reaction is held by the perforated flame holder.

37. The combustion system of claim 1, wherein the combustion reaction actuator is electrically powered.

38. The combustion system of claim 1, wherein a distance between the bluff body and the perforated flame holder is about 5.25 inches.

39. The combustion system of claim 1, wherein a distance between the bluff body and the perforated flame holder is such that an oxygen-to-fuel ratio of a stream of fuel output by the secondary fuel source is at about 1.3 to 1.5 times a stoichiometric ratio of oxygen-to-fuel when the stream reaches the perforated flame holder.

40. The combustion system of claim 1, wherein the combustion reaction actuator is configured to cause a secondary flame to reduce in height when the combustion reaction actuator is activated.

41. The combustion system of claim 1, wherein the primary fuel source includes a nozzle aligned to cause a stream of fuel output by the secondary fuel source to be ignited by the primary combustion reaction and to support the secondary combustion reaction held by the bluff body when electrical power to the combustion reaction actuator is removed.

42. The combustion system of claim 1, further comprising:

a feedback circuit configured to detect the secondary combustion reaction held by the perforated flame holder, and to interrupt electrical power to the combustion reaction actuator when the secondary combustion reaction is not detected.

43. The combustion system of claim 1, further comprising:

a feedback circuit configured to detect the secondary combustion reaction held by the perforated flame holder, and to interrupt electrical power to the combustion reaction actuator when the perforated flame holder is damaged or fails.

44. The combustion system of claim 1, further comprising:

a feedback circuit configured to detect the secondary combustion reaction, held by the perforated flame holder;

wherein the feedback circuit includes:

a detection electrode configured to produce a first voltage signal corresponding to a value of an electrical charge imparted onto the secondary combustion reaction by a combustion reaction charge source;

a sensor node operatively coupled to the detection electrode and configured to hold a second voltage signal corresponding to the first voltage signal; and a logic circuit operatively coupled to the sensor node and configured to control application of a third voltage signal to the combustion reaction actuator according to a value of the second voltage signal.

45. The combustion system of claim 44, wherein the feedback circuit is configured to interrupt electrical power to the combustion reaction actuator in the absence of the electrical charge.

46. A method for operating a combustion system, comprising:

supporting a primary combustion reaction proximate to a bluff body;

outputting a secondary fuel stream to impinge on the bluff body;

holding a secondary combustion reaction of the secondary fuel stream with the bluff body by igniting the secondary fuel stream with the primary combustion reaction; and holding the secondary combustion reaction with a perforated flame holder positioned downstream of the secondary fuel stream from the bluff body by transferring the secondary combustion reaction from the bluff body to the perforated flame holder by removing or reducing an effectiveness of the primary combustion reaction as an ignition source by electrically actuating the primary combustion reaction; and diluting the secondary fuel stream in a region between the bluff body and the perforated flame holder.

47. The method for operating a combustion system of claim 46, wherein diluting the secondary fuel stream in the region between the bluff body and the perforated flame holder causes the secondary combustion reaction held by the perforated flame holder to occur at a lower temperature than when the secondary combustion reaction is held by the bluff body.

48. The method for operating a combustion system of claim 46, wherein diluting the secondary fuel stream in the region between the bluff body and the perforated flame holder causes the secondary combustion reaction held by the perforated flame holder to output reduced oxides of nitrogen (NOx) compared to when the secondary combustion reaction is held by the bluff body.

49. The method for operating a combustion system of claim 46, wherein diluting the secondary fuel stream in the region between the bluff body and the perforated flame holder causes the secondary combustion reaction held by the perforated flame holder to react to substantial completion within a reduced overall secondary combustion flame height than when the secondary combustion reaction is held by the bluff body.

50. The method for operating a combustion system of claim 46, wherein electrically actuating the primary combustion reaction comprises:

deflecting the primary combustion reaction.

51. The method for operating a combustion system of claim 46, wherein electrically actuating the primary combustion reaction comprises:

deflecting the primary combustion reaction with an ionic wind generator.

52. The method for operating a combustion system of claim 51, wherein deflecting the primary combustion reaction with the ionic wind generator includes moving the primary combustion reaction from a first coanda surface to a second coanda surface.

53. The method for operating a combustion system of claim 51, wherein deflecting the primary combustion reaction with the ionic wind generator includes directing the primary combustion reaction along a groove in the bluff body.

54. The method for operating a combustion system of claim 51, wherein deflecting the primary combustion reaction with the ionic wind generator includes reducing output of the primary combustion reaction through holes in the bluff body.

55. The method for operating a combustion system of claim 46, wherein electrically actuating the primary combustion reaction comprises:

reducing a flow of a primary fuel to the primary combustion reaction.

56. The method for operating a combustion system of claim 46, further comprising:

receiving an interruption in electrical power to a primary combustion reaction actuator; and responsive to the interruption in electrical power, holding the secondary combustion reaction with the bluff body.

57. A method for operating a combustion system, comprising:

supporting a primary combustion reaction proximate to a bluff body;

outputting a secondary fuel stream to impinge on the bluff body;

holding a secondary combustion reaction of the secondary fuel stream with the bluff body by igniting the secondary fuel stream with the primary combustion reaction; and holding the secondary combustion reaction with a perforated flame holder positioned downstream of the secondary fuel stream from the bluff body by transferring the secondary combustion reaction from the bluff body to the perforated flame holder by removing or reducing an effectiveness of the primary combustion reaction as an ignition source by electrically actuating the primary combustion reaction;

wherein the perforated flame holder is a reticulated ceramic perforated flame holder.

58. The method for operating a combustion system of claim 57, wherein the perforated flame holder includes a plurality of reticulated fibers.

59. The method for operating a combustion system of claim 58, wherein holding the secondary combustion reaction with the perforated flame holder includes holding the secondary combustion reaction upstream, downstream, and within the perforated flame holder.

60. The method for operating a combustion system of claim 57, wherein the perforated flame holder includes a plurality of perforations formed as passages between the reticulated fibers.

61. The method for operating a combustion system of claim 60, wherein the perforated flame holder includes an input face and an output face downstream of the secondary fuel stream from the input face.

62. The method for operating a combustion system of claim 61, wherein holding the secondary combustion reaction with the perforated flame holder includes supporting at least a portion of the secondary combustion reaction within the perforations between the input face and the output face.

* * * * *